US011519185B2

(12) United States Patent
Brown

(10) Patent No.: US 11,519,185 B2
(45) Date of Patent: Dec. 6, 2022

(54) DECKING ANCHOR, DECKING SYSTEM UTILIZING THE DECKING ANCHOR, AND METHOD OF INSTALLING THE DECKING ANCHOR

(71) Applicant: Verco Decking, Inc., Phoenix, AZ (US)

(72) Inventor: Christopher Lawrence Brown, Whittier, CA (US)

(73) Assignee: VERCO DECKING, INC., Phoenix, AZ (US)

( * ) Notice: Subject to any disclaimer, the term of this patent is extended or adjusted under 35 U.S.C. 154(b) by 0 days.

(21) Appl. No.: 17/132,074

(22) Filed: Dec. 23, 2020

(65) Prior Publication Data

US 2021/0198899 A1 Jul. 1, 2021

Related U.S. Application Data

(60) Provisional application No. 62/954,097, filed on Dec. 27, 2019.

(51) Int. Cl.
*E04F 15/02* (2006.01)
*E04F 15/06* (2006.01)
(Continued)

(52) U.S. Cl.
CPC ..... *E04F 15/02044* (2013.01); *E04B 5/17* (2013.01); *E04F 15/06* (2013.01);
(Continued)

(58) Field of Classification Search
CPC ..... E04F 15/02044; E04F 15/06; E04F 15/08; E04F 2015/02105; E04B 5/17;
(Continued)

(56) References Cited

U.S. PATENT DOCUMENTS 2,924,089 A 2/1960 Reiland
3,005,292 A * 10/1961 Reiland ..... F16B 37/046 52/99
(Continued)

FOREIGN PATENT DOCUMENTS

DE 20015523 U1 1/2001
DE 102014110192 A1 * 1/2016 ..... F16B 37/046
(Continued)

*Primary Examiner* — Theodore V Adamos

(74) *Attorney, Agent, or Firm* — Moore & Van Allen PLLC; Jeffrey R. Gray

(57) ABSTRACT

The decking anchors may have a primary portion and a secondary portion that are operatively coupled together, such as through a fastener. The primary portion may comprise one or more primary projections (e.g., first and second primary projections) and/or the secondary portion may comprise one or more secondary projections (e.g., first and second secondary projections). In a first position adjacent projections may be retracted towards each other. In the first position the anchor may be installed into a cavity of the decking panel. The anchor may be rotated into a pre-installed position, and a force is exerted on the anchor such that the projections contact the webs of the decking. In response to continued force the projections move with respect to each other such that the anchor is moved into an installed position (e.g., the adjacent projections extend with respect to each other).

20 Claims, 25 Drawing Sheets

(51) Int. Cl.
*E04B 5/17* (2006.01)
*E04F 15/08* (2006.01)

(52) U.S. Cl.
CPC ..... *E04F 15/08* (2013.01); *E04B 2005/176* (2013.01); *E04F 2015/02105* (2013.01)

(58) Field of Classification Search
CPC ..... E04B 1/4128; E04B 1/4135; E04B 1/415; E04B 1/4142; E04B 1/4107; E04B 2005/176; F16B 37/045; F16B 37/046; F16B 37/047; F16B 37/042; F16B 13/06; F16B 13/063; F16B 13/066; F16B 13/068; F16B 13/08; F16B 13/0808; F16B 13/0833; F16B 13/084; F16B 13/0891; F16B 13/10
See application file for complete search history.

(56) References Cited

U.S. PATENT DOCUMENTS 4,294,570 A * 10/1981 Meschnig ..... F16B 21/10 411/103
5,044,854 A * 9/1991 Oh ..... F16B 37/00 411/344
7,241,094 B1 * 7/2007 Potts ..... F16B 33/002 411/340
8,240,095 B1 * 8/2012 Meyer ..... E04B 5/40 52/220.2
2005/0034402 A1 2/2005 Johnson
2011/0174951 A1 7/2011 Sander, Jr. et al.
2015/0219141 A1 * 8/2015 English ..... A47B 13/00 29/525.02
2018/0347614 A1 * 12/2018 Reznar ..... F16B 37/046
2019/0195251 A1 6/2019 Bodwell et al.
2020/0354972 A1 * 11/2020 Bogh ..... E04B 5/40
2021/0156413 A1 * 5/2021 Stephan ..... F16B 5/0068

FOREIGN PATENT DOCUMENTS

DE 102014112060 A1 * 2/2016 ..... F16B 37/046
GB 2182369 A * 5/1987 ..... F16B 13/00
GB 2325257 A 11/1998
GB 2347693 A 9/2000
JP 05039647 A 2/1993
JP H0925653 A 9/1997
JP 2838695 B2 12/1998
JP 2002054262 A 2/2002
JP 6262580 B2 1/2018
KR 100270860 B1 8/2000
WO 8802426 A1 4/1988

* cited by examiner

DECKING ANCHOR, DECKING SYSTEM UTILIZING THE DECKING ANCHOR, AND METHOD OF INSTALLING THE DECKING ANCHOR

CROSS REFERENCE AND PRIORITY CLAIM UNDER 35 U.S.C. § 119

The present Application for a Patent claims priority to U.S. Provisional Patent Application Ser. No. 62/954,097 entitled "Decking Anchor, Decking System Utilizing the Decking Anchor, and Method of Installing the Decking Anchor," filed on Dec. 27, 2019 and assigned to the assignees hereof and hereby expressly incorporated by reference herein.

FIELD

This application relates generally to the field of structural decking systems, and more particularly to improvements to decking anchors and decking anchor systems.

BACKGROUND

Structural panels are used in commercial or industrial construction (and in some cases residential construction), for example, as a component of poured concrete floors or as structural roofing (e.g., for commercial buildings, industrial buildings, institutional buildings, or the like). Structural panels may typically be manufactured from steel sheets, which may or may not be coiled. In order to increase the structural strength and the stiffness of the individual steel sheets, structural panels with longitudinal profiles are formed from the steel sheets via roll forming, break forming, bending, stamping, or other like processes. The structural panels are secured to each other in order to form the structural steel panel system when installed. These structural panels may be used as roof decking, floor decking, or wall panels. As such, corrugated structural panels may be used in a variety of building applications. The panels are also connected to the other load resisting structural members of a building, such as steel beams, joists, walls, other structural components, or the like. When the panels are connected to each other in a secure manner for roof or floor applications, the assembled structural steel decking system provides considerable diaphragm (or membrane) strength, which is used to transfer horizontal loads to the vertical and lateral load carrying components of the building. The considerable diaphragm strength may be desirable, in particular, in geographic regions that are prone to seismic activity (e.g., earthquakes) and/or high winds. Moreover, the structural panels are also used to hang components from the decking through the use of anchors. Hanging components, such as lights, HVAC, pipes, and/or other building components, from structural decking (e.g., floor, ceiling or roof structural decking) using traditional anchors can be a time intensive and multi-stepped process.

BRIEF SUMMARY

The present disclosure relates to improved decking anchors, utilizing the decking anchors within structural decking, and in particular dovetail decking, to hang components from the structural decking. The decking anchors of the present disclosure may provide for ease of installation, such as installing using one hand, using a quick snap-in installation feature, installing from the ground using a tool, or the like, as will be described herein.

The decking anchors of the present disclosure may comprise a primary portion (e.g., otherwise described as an upper anchor portion, a fixed anchor portion, or the like) and a secondary portion (e.g., otherwise described as a lower anchor portion, a free anchor portion, or the like) that are operatively coupled together, such as through a fastener. It should be understood that the primary portion may comprise one or more primary projections (e.g., first and second primary projections) and/or the secondary portion may comprise one or more secondary projections (e.g., first and second secondary projections). In a first position (e.g., an assembly position, a retracted position, or the like) adjacent projections may be moved closer to each other, such as a first primary projection and a first secondary projection are retracted towards each other. In the first position (e.g., the retracted position), the anchor may be installed into a cavity of the decking panel. The anchor may be rotated into a pre-installed position, such as rotated approximately 90 or 270 degrees (+/−1, 2, 3, 4, 5, 10, 15, 20, 25, 30, or the like) from the assembly position. A user (e.g., installer, or the like) then exerts a force on the anchor such that the projections contact with the webs (or other features) of the decking within the cavity, and moreover, in response to continued force the projections move with respect to each other (e.g., a secondary anchor portion moves with respect to the primary anchor portion) such that the anchor is moved into an installed position. For example, the first primary projection and the first secondary projection, and the second primary projection and the second secondary projection extend with respect to each other. In the installed position, regardless of the orientation of the anchor, the anchor cannot be removed from the opening in the cavity of the decking panel. The embodiments of the invention will be described in further detail herein.

Embodiments of the invention comprise a decking anchor. The anchor comprises an anchor head. The anchor head comprises a primary anchor portion with one or more primary anchor projections, and a secondary anchor portion with one or more secondary anchor projections. The secondary anchor portion is operatively coupled to the primary anchor portion, and a fastener is operatively coupled to the primary anchor portion or the secondary anchor portion of the anchor head. In an assembly position the primary anchor portion and secondary anchor portion are configured to pass through an opening into a cavity of a flute of decking. The one or more primary anchor projections rotate with respect to the one or more secondary anchor projections to move from the assembly position to an installed position in which the one or more primary anchor projections and the one or more secondary anchor projections contact webs of the decking.

In further accord with embodiments of the disclosure, the one or more primary anchor projections rotate with respect to the one or more secondary anchor projections in response to the one or more primary anchor projections and the one or more secondary anchor projections being biased against the webs in the cavity of the decking.

In other embodiments of the disclosure, the anchor further comprises a biasing member that biases the primary anchor portion and the secondary anchor portion together. In yet other embodiments of the disclosure, the biasing member comprises a compression spring.

In sill other embodiments of the disclosure, the primary anchor portion comprises a primary anchor aperture and the secondary anchor portion comprises a secondary anchor aperture. The primary anchor aperture and the secondary anchor aperture are operatively coupled through the fastener.

In other embodiments of the disclosure, the fastener comprises a fastener threaded portion and primary anchor aperture comprises a primary aperture threaded portion. The fastener threaded portion is operatively coupled to the primary aperture threaded portion.

In further accord with embodiments of the disclosure, the anchor head comprises a locking mechanism. In other embodiments of the invention disclosure, the locking mechanism comprises a tongue and groove connection operatively coupled to the primary anchor portion or the secondary anchor portion. In the assembly position the tongue and groove connection is unlocked, while in the installed position the tongue and groove connection is locked.

In still other embodiments of the disclosure, the primary anchor portion comprises a first primary anchor projection and a second primary anchor projection, and the secondary anchor portion comprises a first secondary anchor projection and a secondary primary anchor projection.

In yet other embodiments of the disclosure, the first primary anchor projection and the first secondary anchor projection contact a first web, and the second primary anchor projection and the second secondary anchor projection contact a second web.

In other embodiments of the disclosure, at least a portion of the one or more primary anchor projections or the one or more secondary anchor projections comprise a curved surface.

In further accord with embodiments of the disclosure, the anchor further comprises a removal mechanism operatively coupled to the primary anchor portion or the secondary anchor portion, wherein the removal mechanism allows movement of the primary anchor portion with respect to the secondary anchor portion.

In other embodiments of the disclosure, the removal mechanism comprises one or more removal apertures in the primary anchor portion or the secondary anchor portion. The one or more removal apertures receives a tool for moving the primary anchor portion with respect to the secondary anchor portion.

In still other embodiments of the disclosure, the anchor further comprises a stop operatively coupled to the fastener, wherein the stop impedes movement of the anchor within the decking when the stop is operatively coupled to the decking.

Embodiments of the invention comprise a decking system having decking and one or more anchors. The decking has a plurality of flutes comprising an upper flange, a portion of a first lower flange and a portion of second lower flange, and webs operatively coupling the upper flange to the first lower flange and the second lower flange. The one or more anchors each comprise an anchor head having a primary anchor portion with one or more primary anchor projections and a secondary anchor portion with one or more secondary anchor projections. The secondary anchor portion is operatively coupled to the primary anchor portion. The one or more anchors further comprise a fastener operatively coupled to the primary anchor portion or the secondary anchor portion of the anchor head. In an assembly position the primary anchor portion and the secondary anchor portion are configured to pass through an opening into a cavity of a flute of the decking. The one or more primary anchor projections rotate with respect to the one or more secondary anchor projections to move from the assembly position to an installed position in which the one or more primary anchor projections and the one or more secondary anchor projections contact webs of the decking.

In further accord with embodiments of the disclosure, the one or more primary anchor projections rotate with respect to the one or more secondary anchor projections in response to the one or more primary anchor projections and the one or more secondary anchor projections being biased against the webs in the cavity of the decking.

In other embodiments of the disclosure, the one or more anchors further comprise a biasing member, wherein the biasing member biases the primary anchor portion and the secondary anchor portion together.

In still other embodiments of the disclosure, the primary anchor portion comprises a primary anchor aperture and the secondary anchor portion comprises a secondary anchor aperture. The primary anchor aperture and the secondary anchor aperture are operatively coupled through the fastener.

In yet other embodiments of the disclosure, the anchor head comprises a locking mechanism.

Embodiments of the invention comprise a method of installing an anchor in decking. The method comprises installing an anchor head into a cavity of a flute within the decking with the anchor head in an assembly position. The decking comprises a plurality of flutes each having an upper flange, a portion of a first lower flange and a portion of second lower flange, and webs operatively coupling the upper flange to the first lower flange and the second lower flange. The anchor comprises an anchor head comprising a primary anchor portion with one or more primary anchor projections, and a secondary anchor portion with one or more secondary anchor projections. The secondary anchor portion is operatively coupled to the primary anchor portion. The anchor further comprises a fastener operatively coupled to the primary anchor portion or the secondary anchor portion of the anchor head. In an assembly position the primary anchor portion and the secondary anchor portion are configured to pass through an opening into the cavity of the flute of the decking. The method further comprises installing the anchor into an installed position. During installation the one or more primary anchor projections rotate with respect to the one or more secondary anchor projections to move from the assembly position to the installed position. The one or more primary anchor projections and the one or more secondary anchor projections contact the webs of the decking in the installed position.

To the accomplishment of the foregoing and the related ends, the one or more embodiments of the invention comprise the features hereinafter fully described and particularly pointed out in the claims. The following description and the annexed drawings set forth certain illustrative features of the one or more embodiments. These features are indicative, however, of but a few of the various ways in which the principles of various embodiments may be employed, and this description is intended to include all such embodiments and their equivalents.

BRIEF DESCRIPTION OF DRAWINGS

The foregoing and other advantages and features of the invention, and the manner in which the same are accomplished, will become more readily apparent upon consideration of the following detailed description of the invention taken in conjunction with the accompanying drawings, which illustrate embodiments of the invention and which are not necessarily drawn to scale, wherein.

DETAILED DESCRIPTION

Embodiments of the present invention now may be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure may satisfy applicable legal requirements. Like numbers refer to like elements throughout.

As will be described in further detail herein, the decking anchors of the present disclosure may comprise a primary portion (e.g., an upper anchor portion, a fixed anchor portion, or the like) and a secondary portion (e.g., a lower anchor portion, a free anchor portion, or the like) that are operatively coupled together, such as through a fastener. It should be understood that the primary portion may comprise one or more primary projections (e.g., first and second primary projections) and/or the secondary portion may comprise one or more secondary projections (e.g., first and second secondary projections). In a first position (e.g., an assembly position, a retracted position, or the like) adjacent projections may be moved closer to each other, such as first primary projection and a first secondary projection are retracted towards each other. In the first position (e.g., the retracted position), the anchor may be installed into a cavity of the decking. The anchor may be rotated into a pre-installed position. A user (e.g., installer, or the like) then exerts a force on the anchor such that the projections contact with the webs (or other features) within the cavity of the flute of the decking panel, and thereafter, in response to continued force, the projections move with respect to each other such that the anchor is in an installed position. For example, the first primary projection and the first secondary projection, and the second primary projection and the second secondary projection extend with respect to each other. In the installed position regardless of the orientation of the anchor, the anchor head cannot be removed from the opening in the cavity of the flute of the decking panel. The embodiments of the invention will be described in further detail herein.

Figure 1:
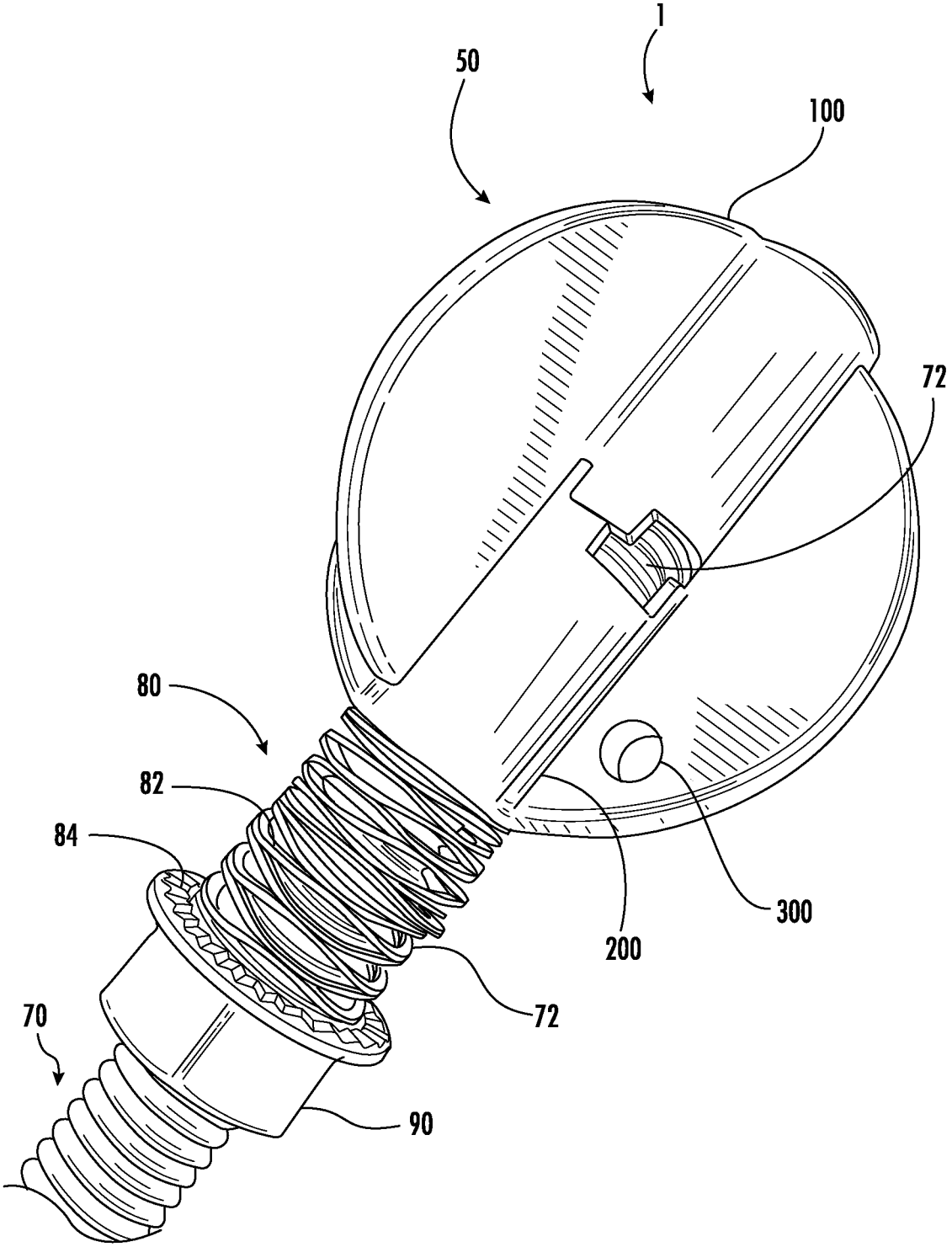
FIG. 1 illustrates a perspective view of an anchor in an assembly position, in accordance with some embodiments of the present disclosure.
Figure 2:
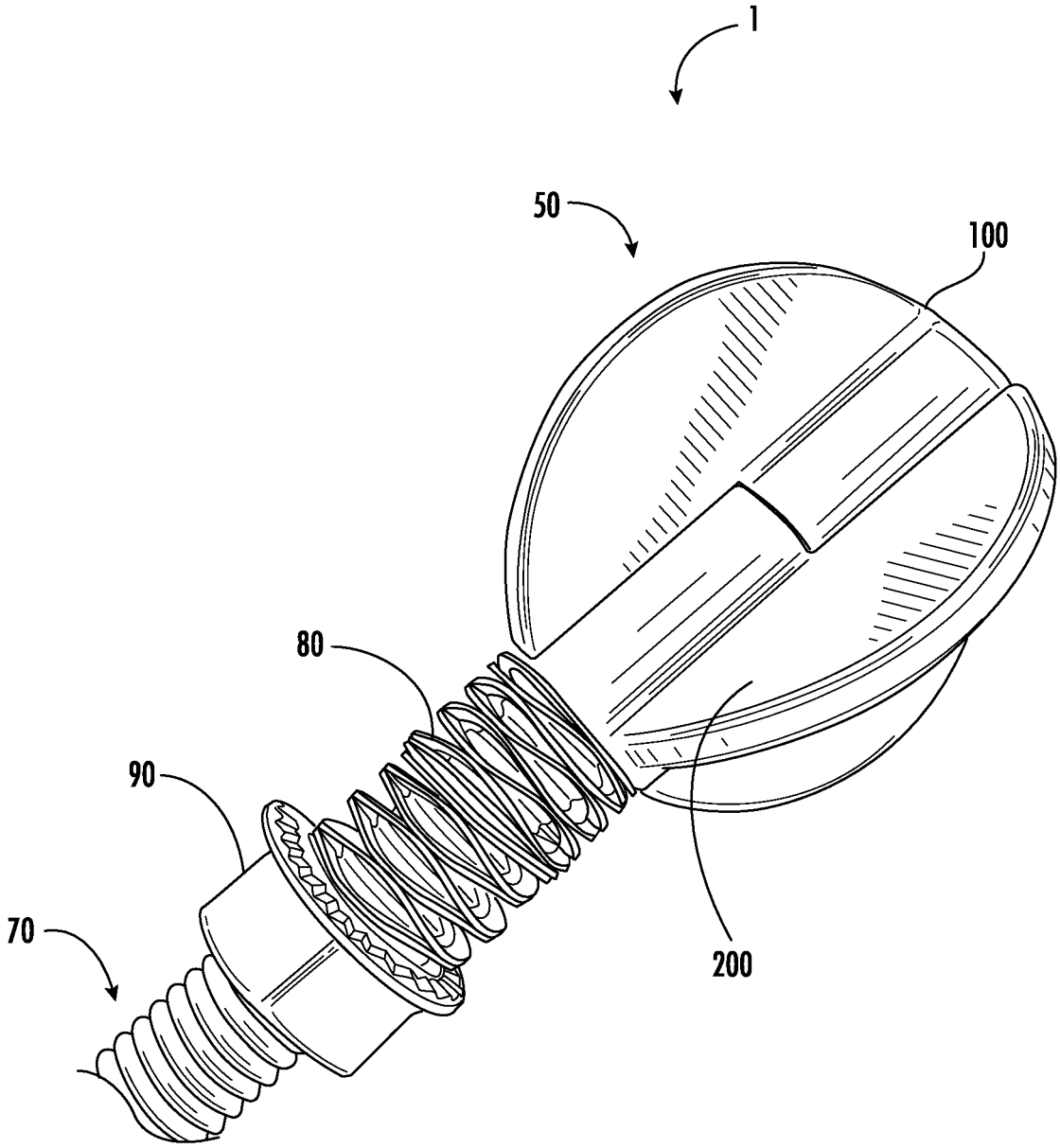
FIG. 2 illustrates a perspective view of an anchor in an installed position, in accordance with some embodiments of the present disclosure.
Figure 3A:
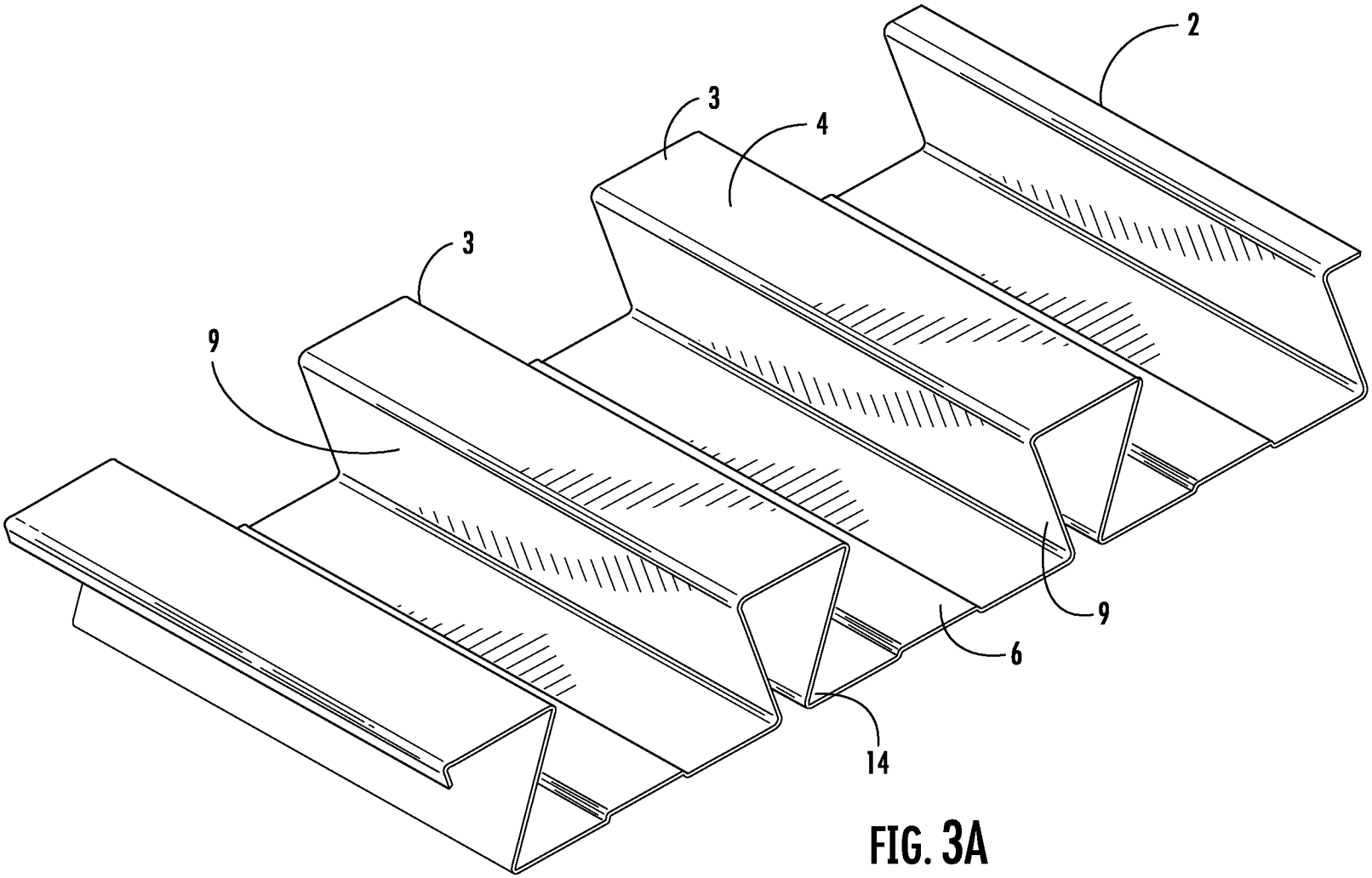
FIG. 3A illustrates a perspective view of a dovetail decking system, in accordance with some embodiments of the present disclosure.
Figure 3B:
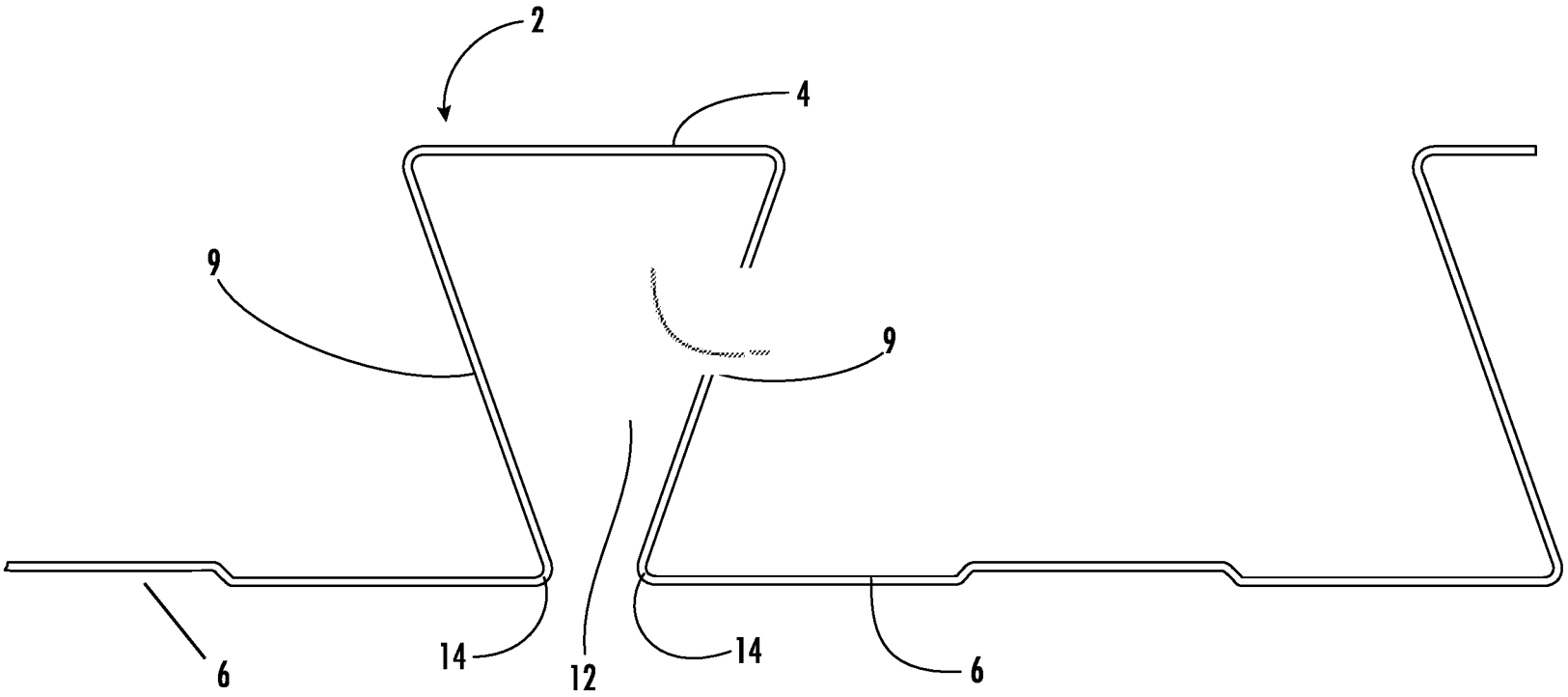
FIG. 3B illustrates a perspective view of a dovetail decking system, in accordance with some embodiments of the present disclosure.

FIGS. 1 and 2 illustrate an anchor 50 in an assembly position (e.g., retracted position) and an installed position (e.g., extended position), respectfully, as will be described in further detail herein. The anchor 50 may be used to quickly and easily assemble anchors 50 into a decking panel system 1 using a single hand, as will be described herein. FIGS. 3A and 3B illustrate a structural decking panel system 1, comprising one or more structural decking panels 2 (otherwise referred to herein as a "panel", "structural panel", "decking", or "structural decking"), and in particular, a dovetail structural decking panel 2. As will be described herein, the use of the dovetail decking along with the embodiments of the anchor 50 described herein provides an improved decking anchor system 1 that allows for improved installation, and in particular, improved installation utilizing a single hand and/or from the floor without having to utilize a latter, lift, or other component to raise an installer to adjacent the panels 2. The decking system 1, including the decking 2 and the anchors 50, may be manufactured from a variety of rigid materials including steel, aluminum, titanium, plastic, a composite, or another type of rigid material. Typical structural decking panels are 2 made of steel and are sized in ranges from 12 inches to 42 inches wide, inclusive, by 1 foot to 50 feet long, inclusive. These dimensions include some sizes of structural decking panels 2, but it should be understood that the structural decking panels 2 may be sized within these ranges, overlapping these ranges, or outside of these ranges (or any values therein) and utilized with the present invention. The material thickness of the structural decking panels 2 may be any thickness; however, typical panel thicknesses may range from 29 gage panels to 16 gage panels, inclusive (or up to 14 gage, inclusive). Other material thicknesses of the present invention may be within this range, overlap this range, or be located outside of this range (or between any values within these ranges).

As illustrated in FIGS. 3A through 5, the structural decking panels 2 may have a dovetail decking profile that includes top flanges 4 (otherwise described as peaks, upper flanges, outer flanges, or the like), bottom flanges 6 (otherwise described as troughs, lower flanges, inner flanges, or the like), and webs 9 (e.g., the portions of the panel that may be straight or sloped between the flanges 4, 6) that operatively couple the top flanges 4 to the bottom flanges 6, all of which will be generally discussed in further detail below. The combination of top flange 4, bottom flanges 6 (or portions of multiple bottom flanges 6 adjacent the top flange 4), and the webs 9 create a flute 3 for the structural decking panel 2. The interior of the top flange 4 and webs 9 form a cavity 10, and the webs 9 and portions of the bottom flanges 6 create an opening 12 for accessing the cavity 10. It should be understood that each decking panel 2 may comprise multiple flutes 3. The distance from the top of the top flange 4 and the bottom of the bottom flange 6 may generally range from a ½ inch to 1, 2.5, 3, 3.5, 4.5, 5, or the like inches in depth; however, other ranges of depths within this range, overlapping this range, or outside of this range, or values within, may be used in the profiles. For example, in some embodiments the distance may range from ½ inch to 12 inches in depth, or the like. The decking panels 2 may or may not include longitudinal ribs, bends, or cutouts that impact the moment of inertia and section modulus of the panels 2 (e.g., profile dimensions, ribs, cutouts, or the like are used to target different performance characteristics, such as but not limited to strength and/or stiffness). Depending on the material thickness, the length and width of the decking panels 2, and the height formed by the top flanges 4 and bottom flanges 6, the decking panels 2 may weigh between 100 and 420 lbs., inclusive. In other embodiments, the weight of the panels 2 may be within, overlap, or be located outside of this range.

Structural decking panels 2 may be operatively coupled to each other through the use of sidelaps 20. The sidelaps may be any type of sidelap, such as but not limited to an overlapping sidelap, a standing sidelap seam, a nested sidelap, a sidelap using a reinforcing member, or any other sidelap in which one panel edge is operatively coupled to another edge. For example, panel edges (e.g., the opposite longer sides of the structural panel 2) may be formed into lips that couple a first structural decking panel 2 to an adjacent second structural decking panel 2. The lips on opposite edges of a structural panel 2 may include a "lower lip" 22 and an "upper lip" 24, which may overlap, overlay each other, nest with respect to each other, or the like. Couplings (also described as joints, connections, attachments, or the like) may be formed in the sidelaps of the structural decking panels 2 to couple adjacent structural panels 2 to each other.

The sizes and thicknesses of the structural decking panels 2 are determined based on the engineering requirements for the desired application of the structural panel systems. In one particular embodiment of the invention, the structural decking panels 2 are used as floors and/or roofs within a building and are required to meet the structural requirements for withstanding loading, such as potential seismic activity, high winds, and/or other natural or man-made forces. Moreover, the anchors that are used to install building components (e.g., pipes, vents, ducts, equipment, or the like) must also be able to resist different types of loading, in some embodiments in multiple directions, but in particular vertical loading from the weight of the components that hang from the anchors. In some embodiments the anchors must withstand loading from seismic activity, high winds, and/or other natural forces, and/or manmade forces related to use of the structure itself.

FIGS. 1 and 2 and 4A through 28 illustrates embodiments of the anchors 50 and/or features thereof, as will be described herein in further detail. As illustrated in FIGS. 1 and 2, the anchor 50 comprises an anchor head 60 operatively coupled to a fastener 70. The fastener 70 may be any type of fastener 70, such as but not limited to a bolt, screw, rod, rivet, or the like of any shape or size (e.g., round, oval, square, rectangular, or the like), and may or may not have a threaded portion 72 thereon. The fastener 70 may be operatively coupled to the anchor head 60 in any way, such as integrally, removeably, or the like. In some embodiments, the fastener 70 may be operatively coupled to the anchor head 60 through a threaded connection (e.g., with a portion of the anchor head 60 or other element, such as a nut, or the like), press fit, flanged, welded, or other like connection.

FIGS. 6 through 28 illustrate embodiments of the anchor head 60, in accordance with various embodiments of the present disclosure. The anchor head 60 may comprise a primary anchor portion 100 (e.g., an upper anchor portion, a fixed anchor portion, or the like) and a secondary anchor portion 200 (e.g., a lower anchor portion, a free anchor portion, or the like) that are operatively coupled together, such as through a fastener 70. We note that while one portion of the anchor head 60 is described as primary and another portion of the anchor head 60 is described as secondary, these terms are only used to describe separate portions of the anchor head 60 and do not relate to the importance, position, function, or the like with respect to the anchor head 60. As such, the primary anchor portion 100 and the secondary anchor portion 200 could be described in reverse without changing the function of the anchor 50 (e.g., reverse primary and secondary). It should be understood that the primary anchor portion 100 and the secondary anchor portion 200 may be the same part, have the same or similar parts, or be completely different. As such, in some embodiments the primary anchor portion 100 and the secondary anchor portion 200 may be same part operatively coupled together inversely with respect to each other. Alternatively, as illustrated in FIGS. 6 through 11, the primary anchor portion 100 and the secondary anchor portion 200 may be the same as each other except one portion may have a threaded feature (e.g., illustrated as the primary anchor portion 100).

Figure 5:
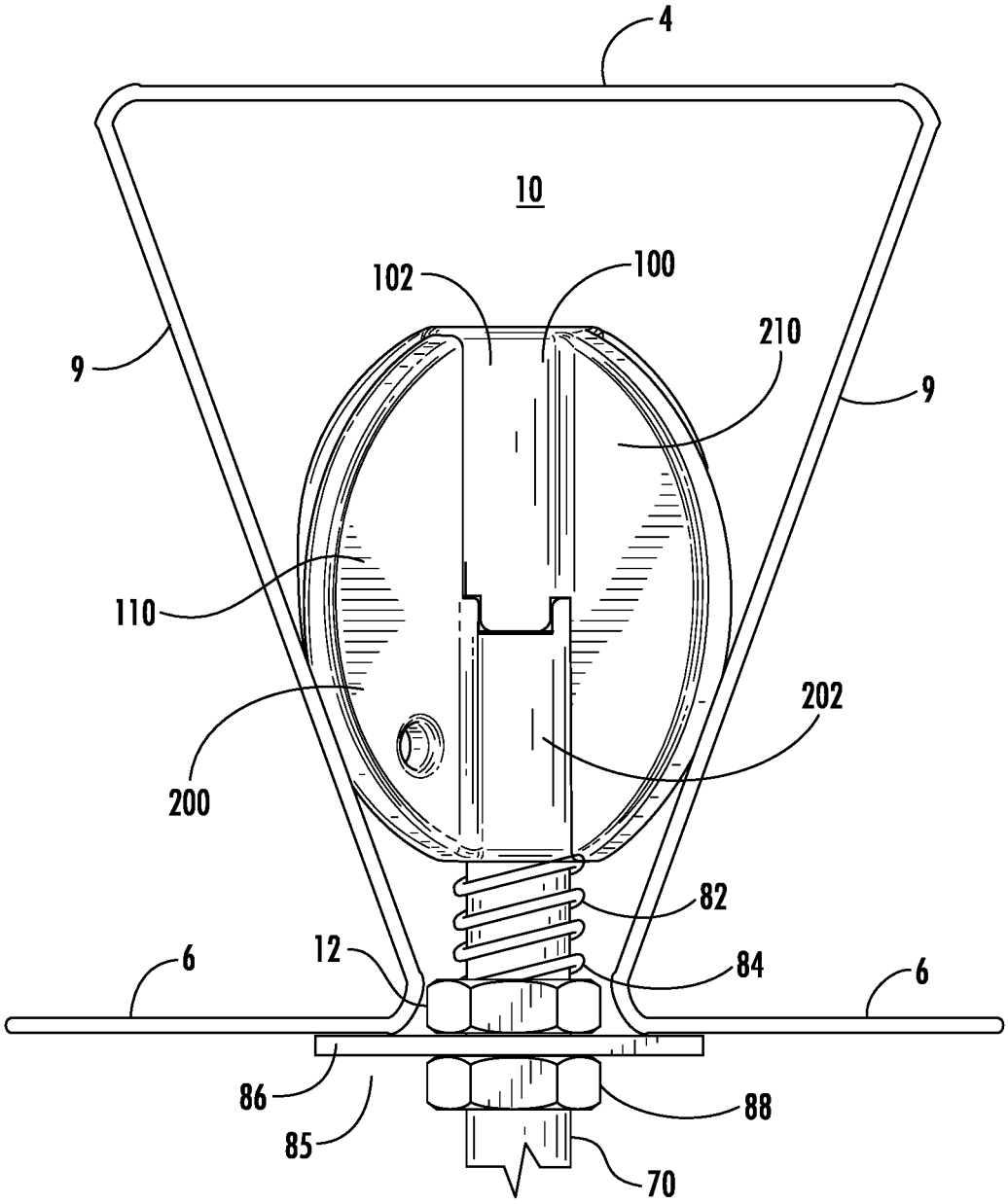
FIG. 5 illustrates an end view of an anchor in an installed position within the cavity of a flute of a decking panel, in accordance with some embodiments of the present disclosure.
Figure 6:
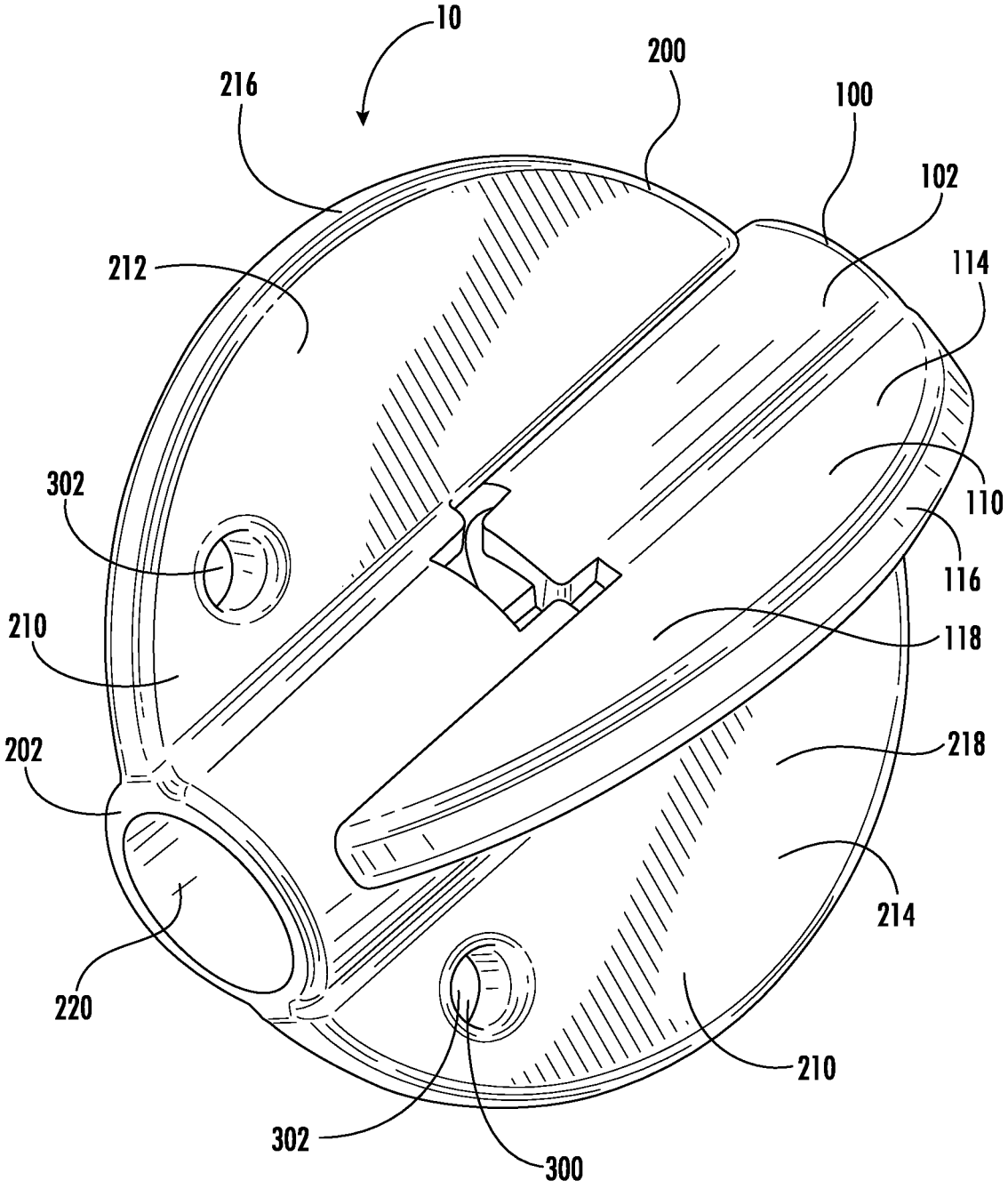
FIG. 6 illustrates a perspective view of an anchor head comprising a primary anchor portion operatively coupled to a secondary anchor portion, in accordance with some embodiments of the present disclosure.
Figure 7:
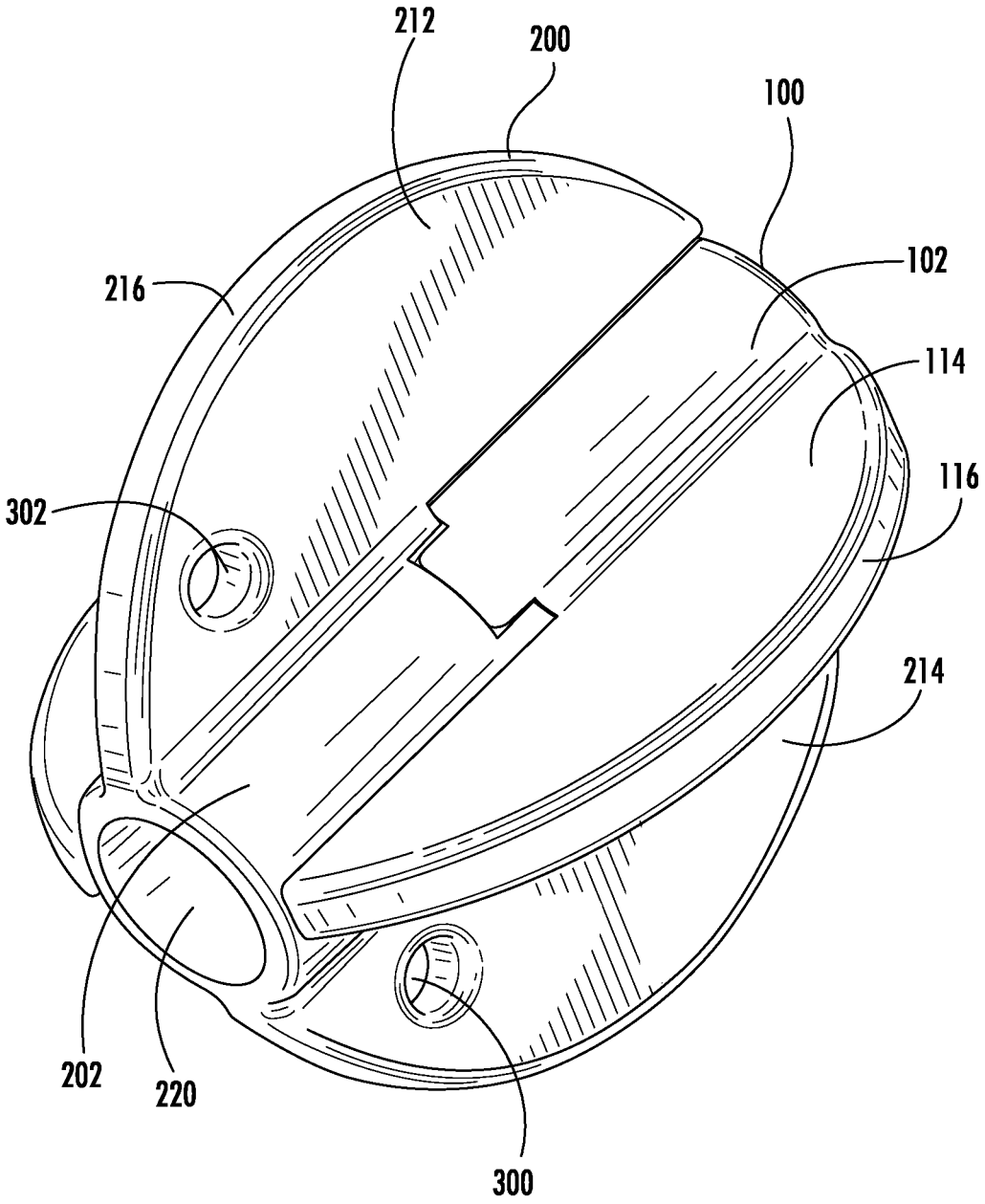
FIG. 7 illustrates a perspective view of an anchor head comprising a primary anchor portion operatively coupled to a secondary anchor portion in an installed position, in accordance with some embodiments of the present disclosure.
Figure 8:
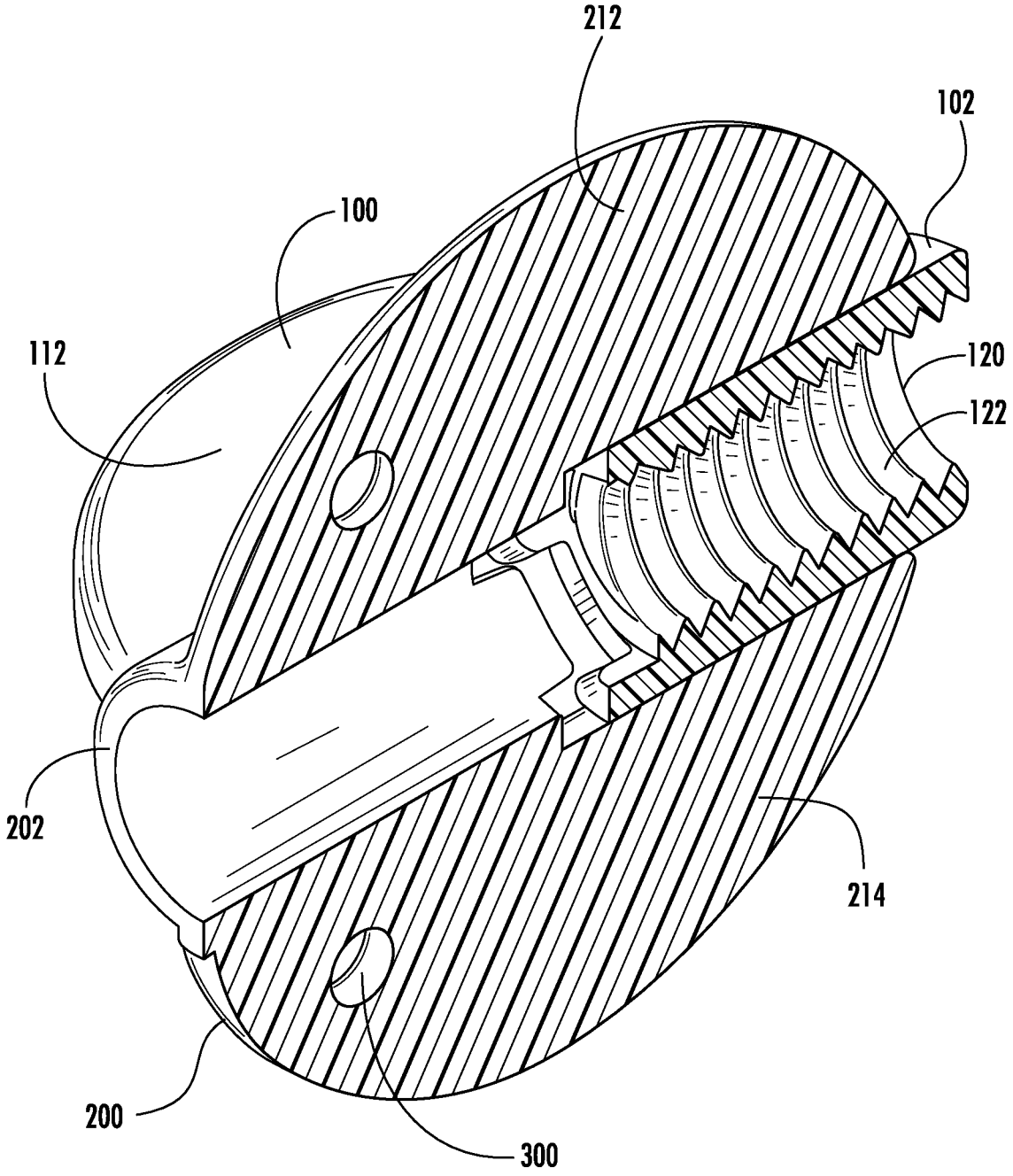
FIG. 8 illustrates a perspective cross-sectional view of an anchor head comprising a primary anchor portion operatively coupled to a secondary anchor portion, in accordance with some embodiments of the present disclosure.
Figure 9:
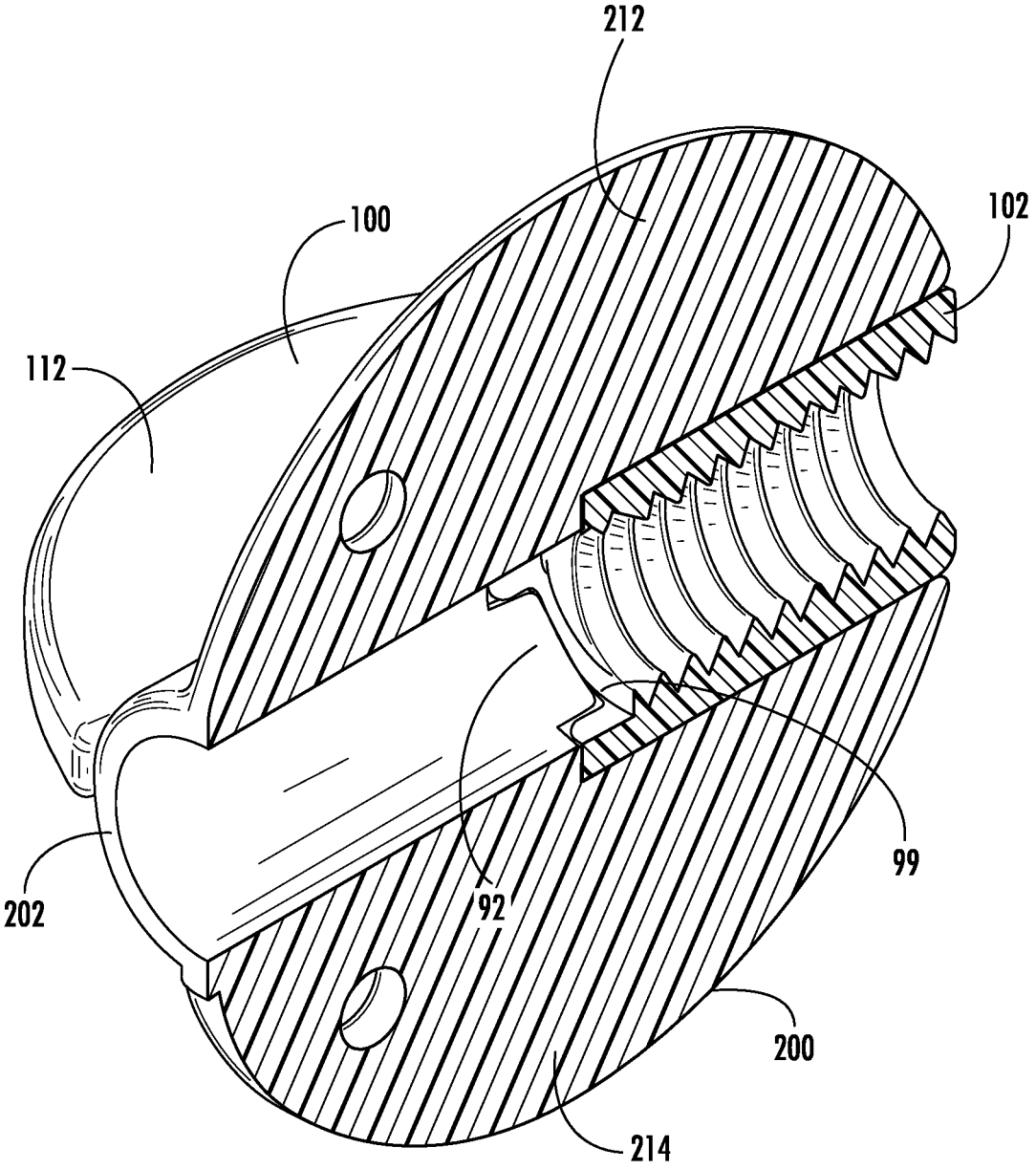
FIG. 9 illustrates a perspective cross-sectional view of an anchor head comprising a primary anchor portion operatively coupled to a secondary anchor portion in an installed position, in accordance with some embodiments of the present disclosure.
Figure 10:
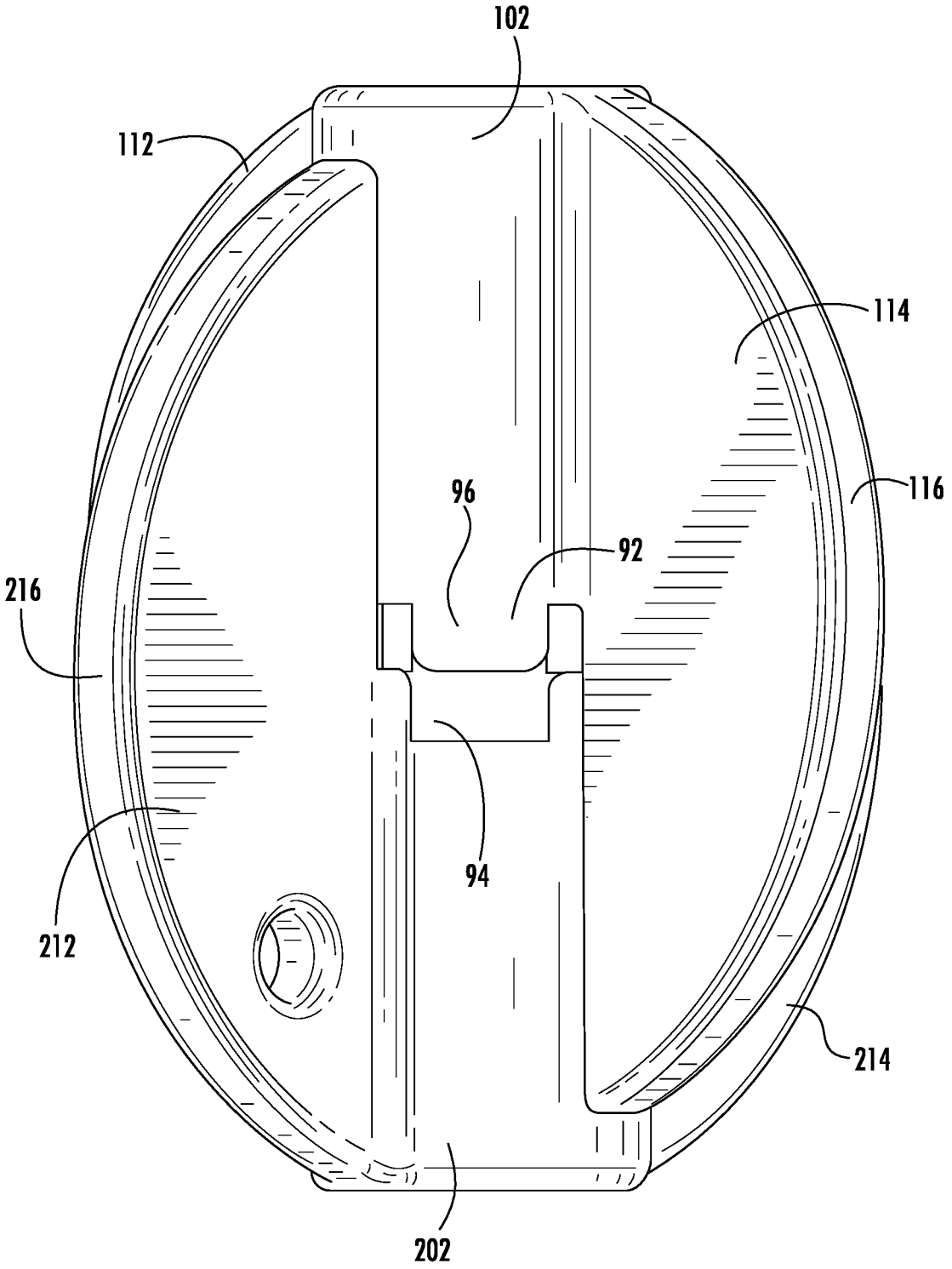
FIG. 10 illustrates a side view of an anchor head comprising a primary anchor portion operatively coupled to a secondary anchor portion, in accordance with some embodiments of the present disclosure.
Figure 11:
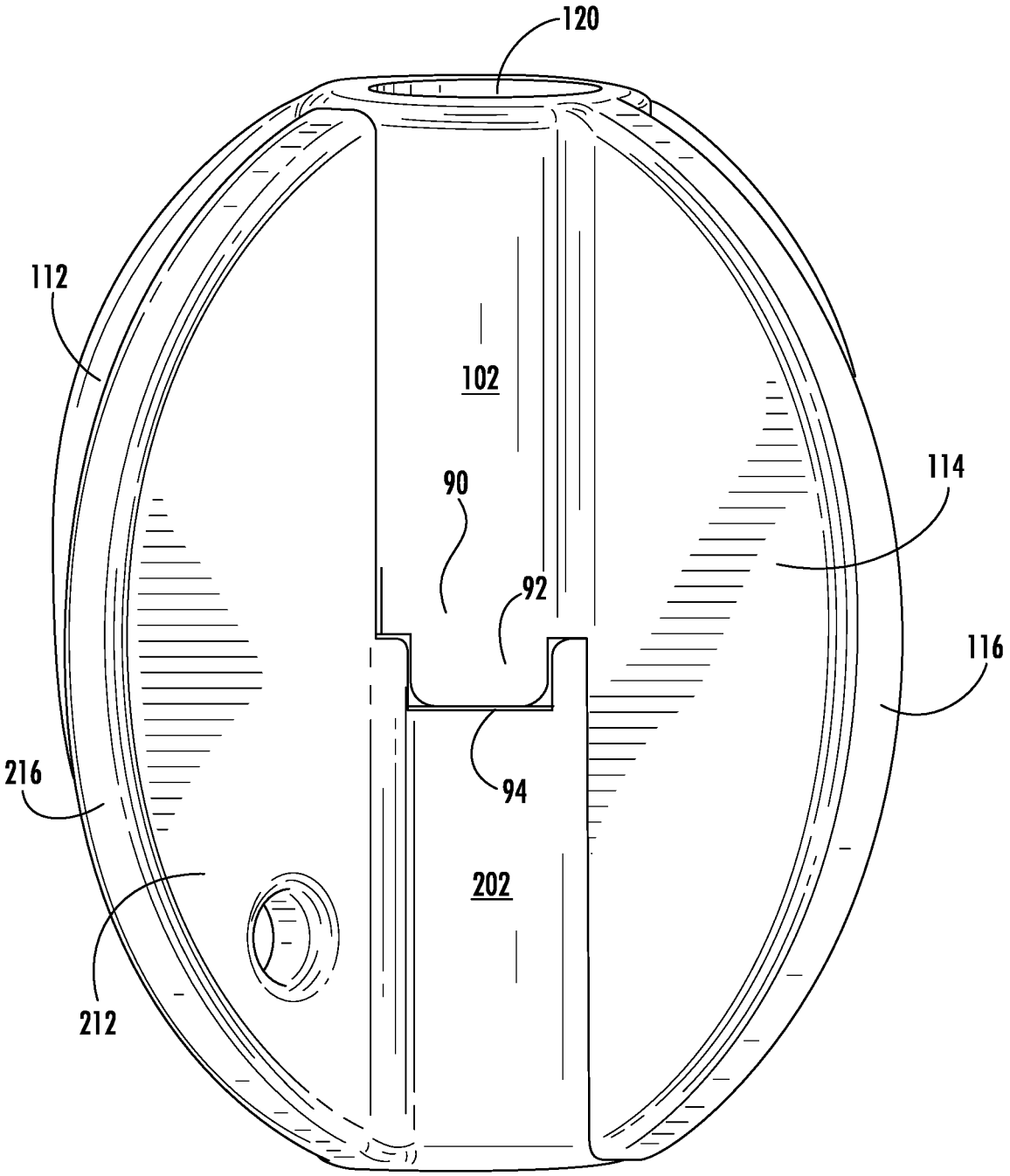
FIG. 11 illustrates a side view of an anchor head comprising a primary anchor portion operatively coupled to a secondary anchor portion in an installed position, in accordance with some embodiments of the present disclosure.

It should be understood that the primary anchor portion 100 may comprise a primary anchor body 102 and one or more primary anchor projections 110 (e.g., first primary anchor projection 112, second primary anchor projection 114, or the like) extending from the primary anchor body 102. In some embodiments, the first primary anchor projection 112 and the second primary anchor projection 114 may be opposing primary anchor projections 110 (e.g., extending 180 degrees+/−5, 10, 15, 20, 25, or the like degrees from each other). However, it should be understood that the opposing primary anchor projections 110 may be located anywhere on the primary anchor body 102 (e.g., circumferentially around, or the like). The primary anchor projections 110 may have primary projection surfaces 116, for which at least a portion thereof contact the webs 9 (e.g., interact, engage, or the like) of the decking panels 2 in the installed position, as illustrated in FIG. 5.

The primary anchor body 102 may be of any size or shape, such as having a cross-sectional shape being circular, oval, square, rectangular, any polygonal, any non-uniform, or the like shape. In some embodiments the primary anchor body 102 may have at least one portion that is cylindrical. Moreover, the primary anchor body 102 may further have a primary anchor aperture 120, such as a hole extending into, or through, the primary anchor body 102. In some embodiments the primary anchor aperture 120 may comprise primary anchor threads 122. As such, a fastener 70 may extend into, or through, the anchor body 102 and/or the fastener threads 72 may be threaded to the primary anchor threads 122. In this way the fastener 70 may be fixed with respect to the primary anchor portion 100.

Like the primary anchor portion 100, the secondary anchor portion 200 of the anchor head 60 may comprise a secondary anchor body 202 and one or more secondary anchor projections 210 (e.g., first secondary anchor projection 212, second secondary anchor projection 214, or the like) extending from the secondary anchor body 102. In some embodiments, the first secondary anchor projection 212 and the second secondary anchor projection 214 may be opposing secondary anchor projections 210 (e.g., extending 180 degrees+/−5, 10, 15, 20, 25, or the like degrees from each other, or in any position around the secondary anchor body 102). The secondary anchor projections 210 may have secondary projection surfaces 216, and a portion thereof may contact the webs 9 (e.g., interact, engage, or the like) within the cavity 10 of the flute 3 of the decking panels 2 in the installed position, as illustrated in FIG. 5.

The secondary anchor body 202, like the primary anchor body 102, may be made of any size or shape, such as a cross-sectional shape being circular, oval, square, rectangular, or the like. In some embodiments the secondary anchor body 202 may have at least one portion that is cylindrical. Moreover, the secondary anchor body 202 may further have a secondary anchor aperture 220, such as a through hole extending into, or through, the secondary anchor body 102. As such, a fastener 70 may extend into the secondary anchor body 202, and the anchor body 202 may move with respect to the fastener 70 (e.g., move longitudinally along a portion of the length of the fastener 70, rotate around the circumference of the fastener 70, or the like).

The one or more primary anchor projections 110 and/or the one or more secondary anchor projections 210 may be made in any shape. For example, the projections 110, 210 may have a curved surface 116, 216 such as half-circle (as illustrated), quarter-circle, hyperbolic, parabolic, concave, convex, or any other like curved surface that is uniform or non-uniform. In other embodiments, the projections 110, 210 may have one or more liner surfaces 116, or combinations of liner and curved surfaces 116. In the illustrated embodiments, the projections 110, 210 are curved (e.g., instead of liner) in order to allow the anchors 50 to be operatively coupled to and within any dovetail decking panel 2 have a flute 3 with webs 9 of any angle (e.g., with respect to the top flanges 4 and/or bottom flanges 6).

The one or more primary projection surfaces 116 and/or the one or more secondary projection surfaces 216 may contact the webs 9 using a point, line, or surface-to-surface contact. As such, as illustrated the end surfaces 116, 216 of the projections 110, 210 may be perpendicular with the extension surfaces 118, 218 of the projections 110, 210. Alternatively, in some embodiments the one or more primary projection surfaces 116 and the one or more secondary projection surfaces 216 may be angled with respect to the one or more primary extension surfaces 118 and the one or more secondary extension surfaces 218. As such, in the installed position it should be understood that in some embodiments the one or more primary projection surfaces 116 and the one or more secondary projection surfaces 216 may contact the webs 9 using surface to surface contact. For example, when the anchor projections are in the extended position, the one or more primary projection surfaces 116 and the one or more secondary projection surfaces 216 may sit flush with the surfaces of the first web 9 and the second web 9.

As illustrated in FIGS. 1 and 2, the anchor 50 may comprise a biasing member 80 used to bias the primary anchor portion 100 and the secondary anchor portion 200. In some embodiments, the biasing member 80 may comprise a compression spring, tension spring, expression spring, constant force spring, leaf spring, or the like. As such, the biasing member 80 may comprise a spring 82 and catch 84 (e.g., nut or the like used to set the biasing of the spring by setting the compression of the spring). In some embodiments the catch 84 and the stop 90 described in further detail herein may be the same feature or integral with each other. In other embodiments, the biasing member 80 may be another type of biasing member 80. The biasing member 80 may be utilized in order to allow for movement of the primary anchor portion 100 with respect to the secondary anchor portion 200 (e.g., biased towards, away, or the like from each other). For example, the secondary anchor body 102 may be biased against the secondary anchor body 202 in order to resist the primary anchor portion 100 from further movement with respect to the secondary anchor portion 200, as will be described in further detail herein. It should be understood the biasing member 80 may be located at least partially below the bottom of the secondary anchor portion 200, above the primary anchor portion 100, between the primary anchor portion 100 and secondary anchor portion 200, and/or overlapping primary anchor portion 100 and/or secondary anchor portion 100.

Figure 12:
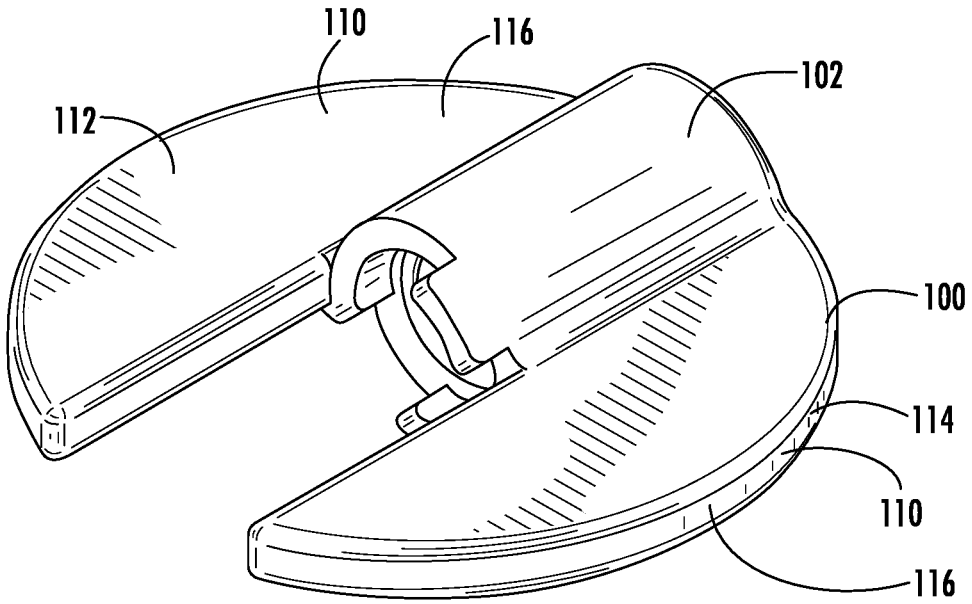
FIG. 12 illustrates a perspective view of a primary anchor portion, in accordance with some embodiments of the present disclosure.
Figure 13:
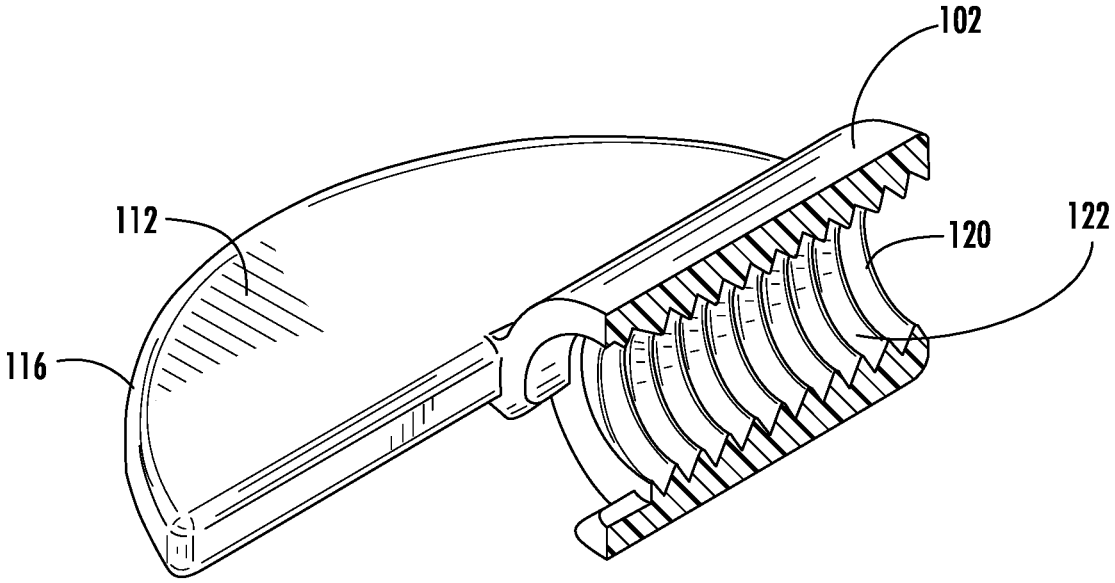
FIG. 13 illustrates a perspective cross-sectional view of a primary anchor portion, in accordance with some embodiments of the present disclosure.
Figure 14:
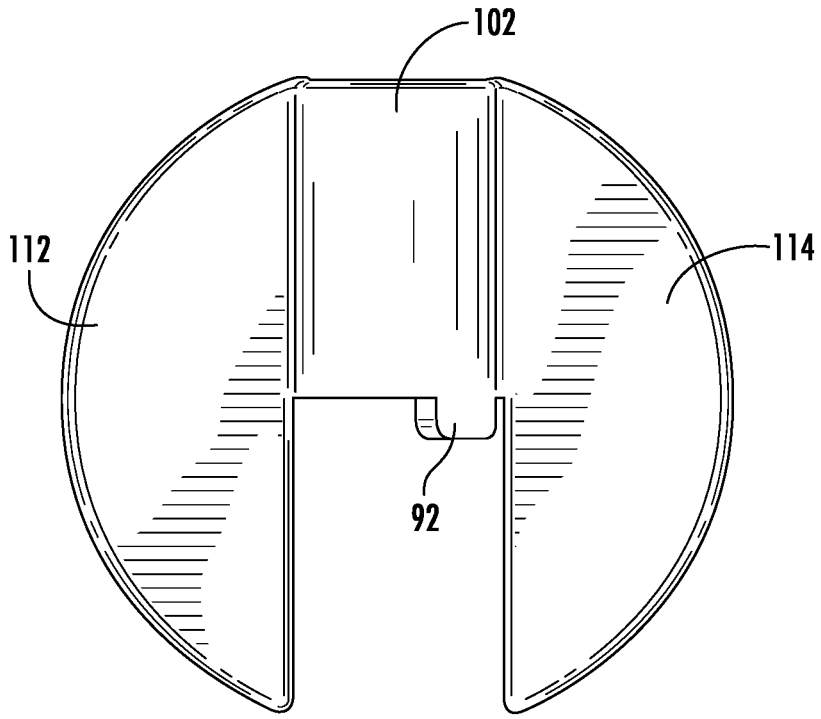
FIG. 14 illustrates a side view of a primary anchor portion, in accordance with some embodiments of the present disclosure.
Figure 15:
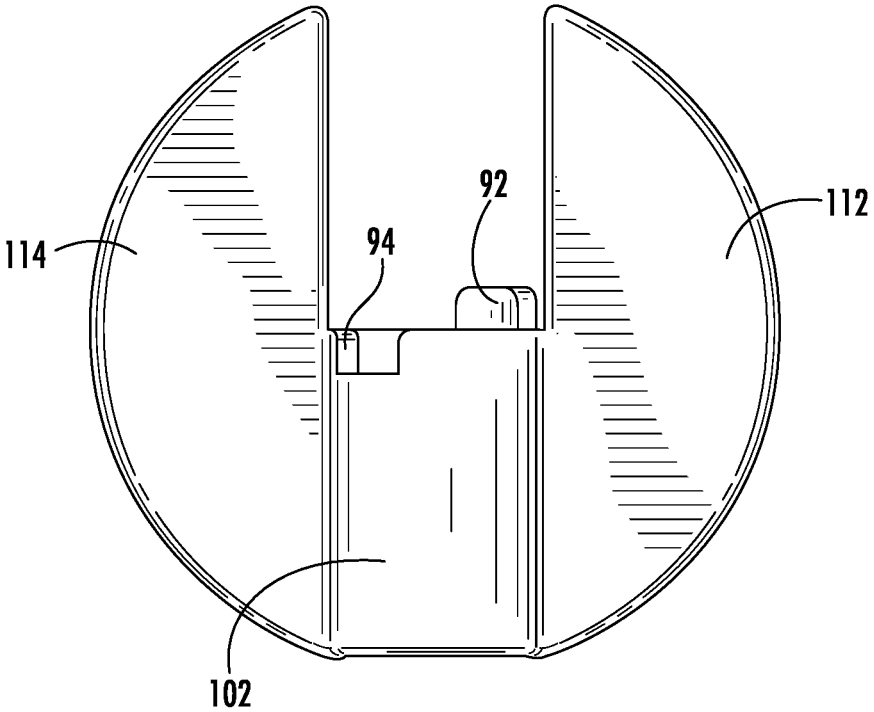
FIG. 15 illustrates a side view of a primary anchor portion, in accordance with some embodiments of the present disclosure.
Figure 16:
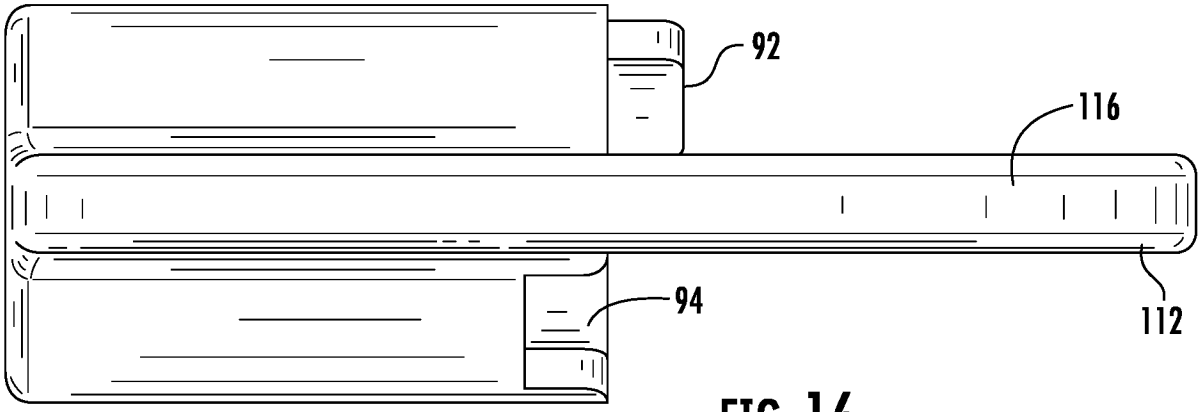
FIG. 16 illustrates an edge view of a primary anchor portion, in accordance with some embodiments of the present disclosure.
Figure 17:
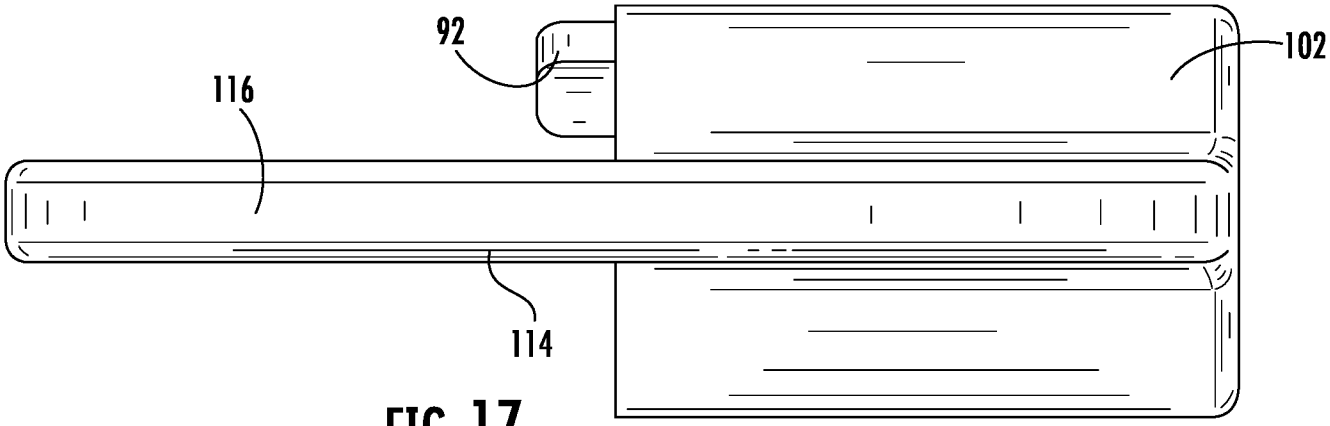
FIG. 17 illustrates an edge view of a primary anchor portion, in accordance with some embodiments of the present disclosure.
Figure 18:
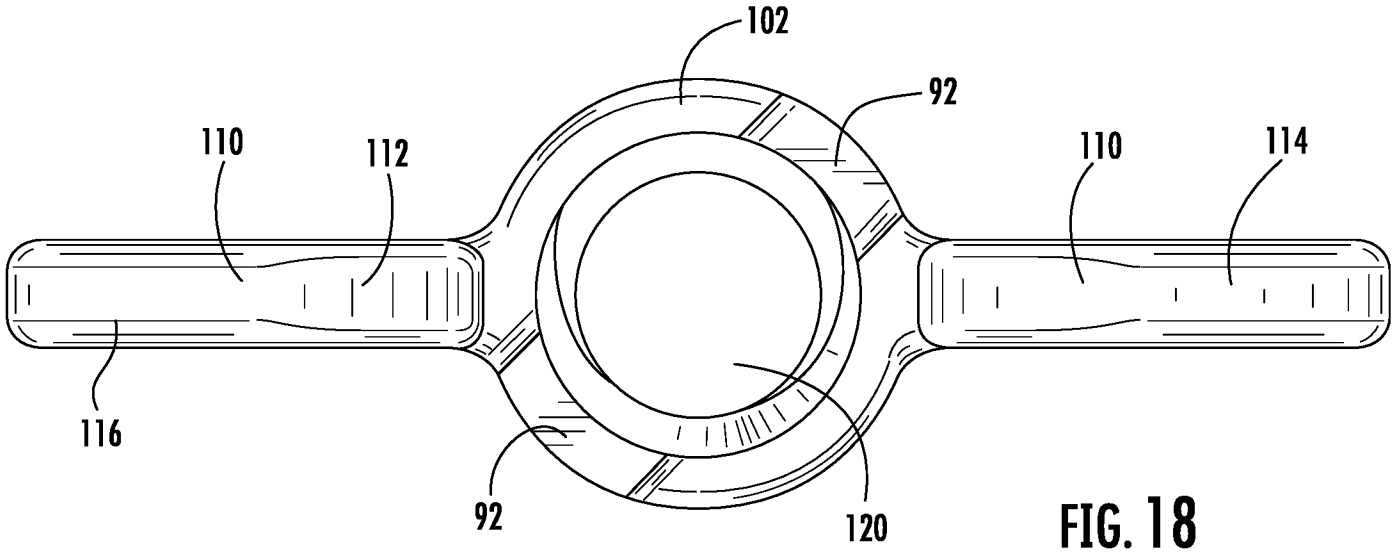
FIG. 18 illustrates a bottom view of a primary anchor portion, in accordance with some embodiments of the present disclosure.
Figure 19:
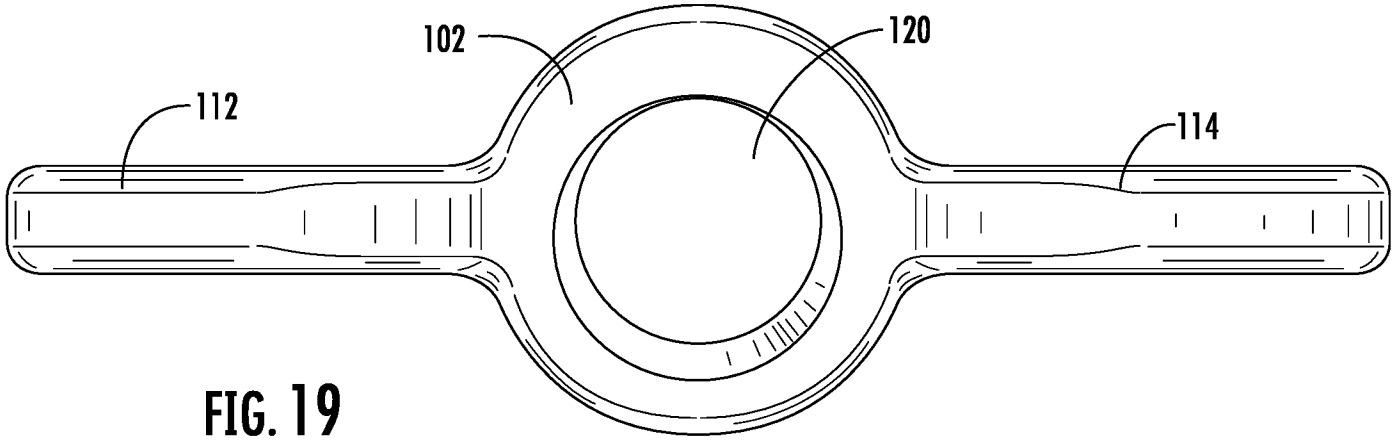
FIG. 19 illustrates a top view of a primary anchor portion, in accordance with some embodiments of the present disclosure.
Figure 20:
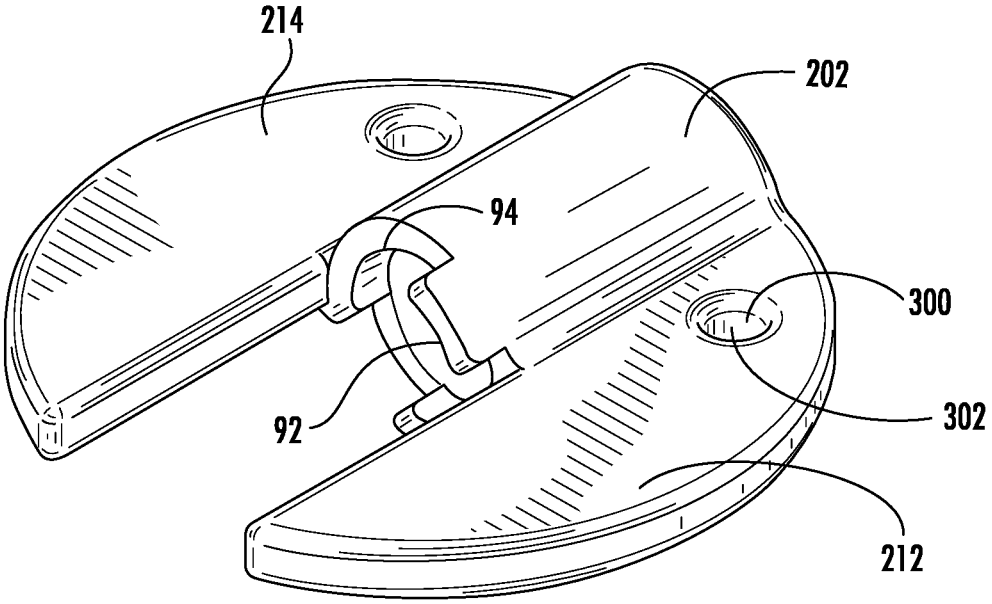
FIG. 20 illustrates a perspective view of a secondary anchor portion, in accordance with some embodiments of the present disclosure.
Figure 21:
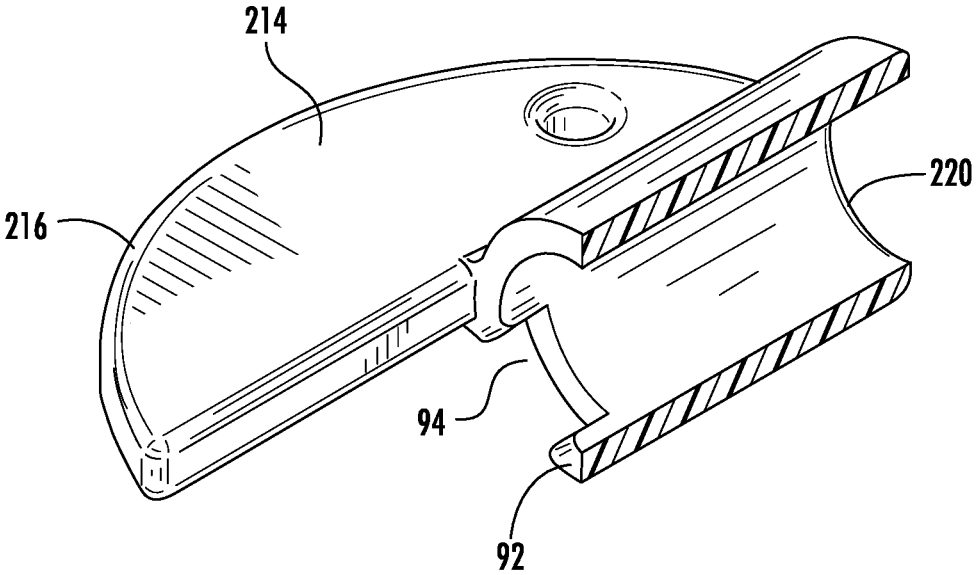
FIG. 21 illustrates a perspective cross-sectional view of a secondary anchor portion, in accordance with some embodiments of the present disclosure.
Figure 22:
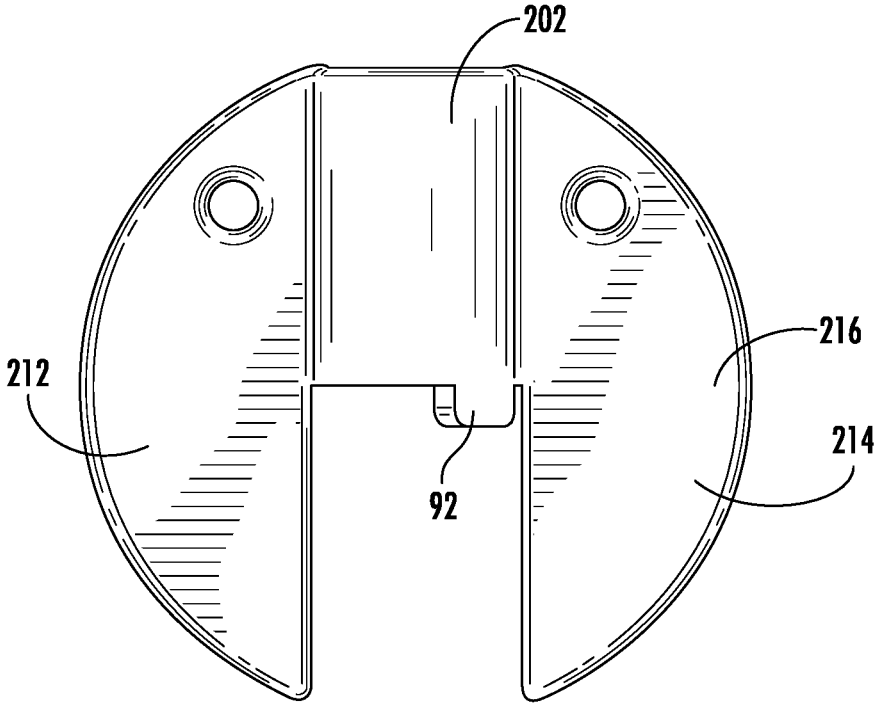
FIG. 22 illustrates a side view of a secondary anchor portion, in accordance with some embodiments of the present disclosure.
Figure 23:
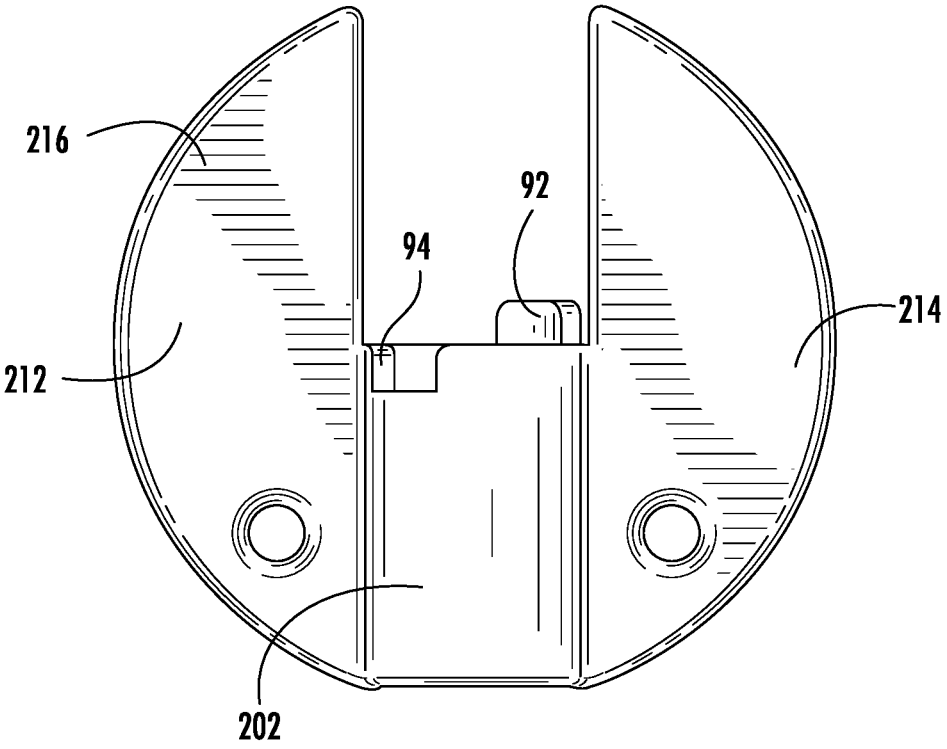
FIG. 23 illustrates a side view of a secondary anchor portion, in accordance with some embodiments of the present disclosure.
Figure 24:
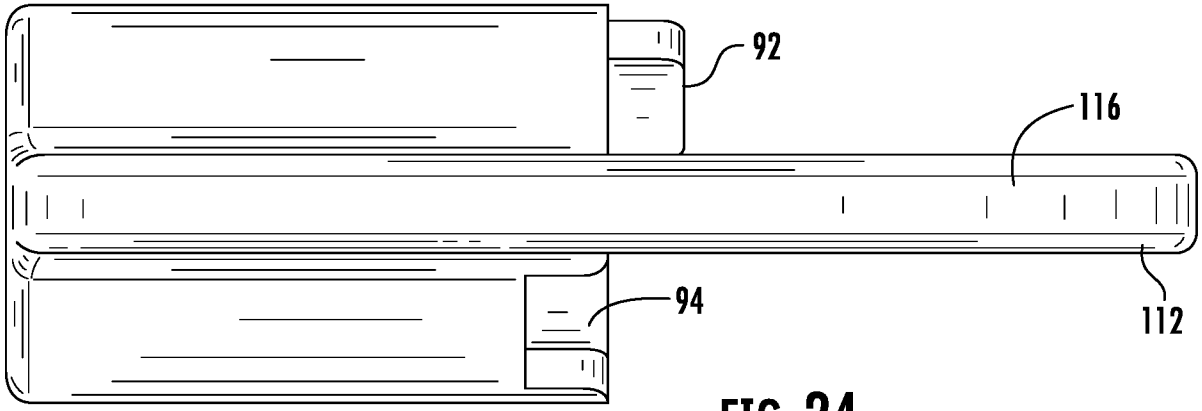
FIG. 24 illustrates an edge view of a secondary anchor portion, in accordance with some embodiments of the present disclosure.
Figure 25:
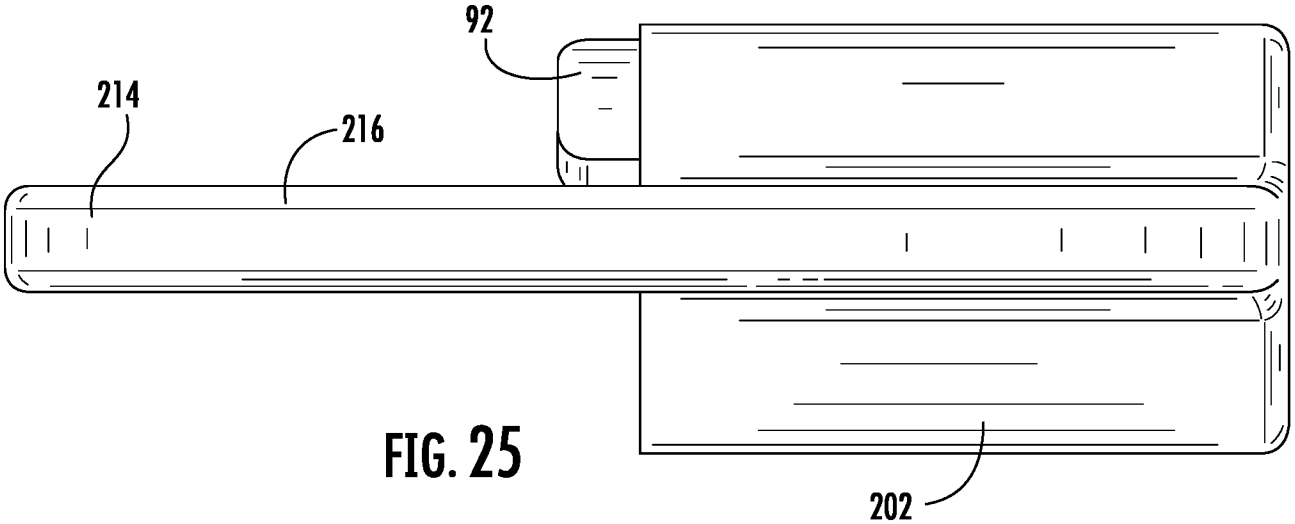
FIG. 25 illustrates an edge view of a secondary anchor portion, in accordance with some embodiments of the present disclosure.
Figure 26:
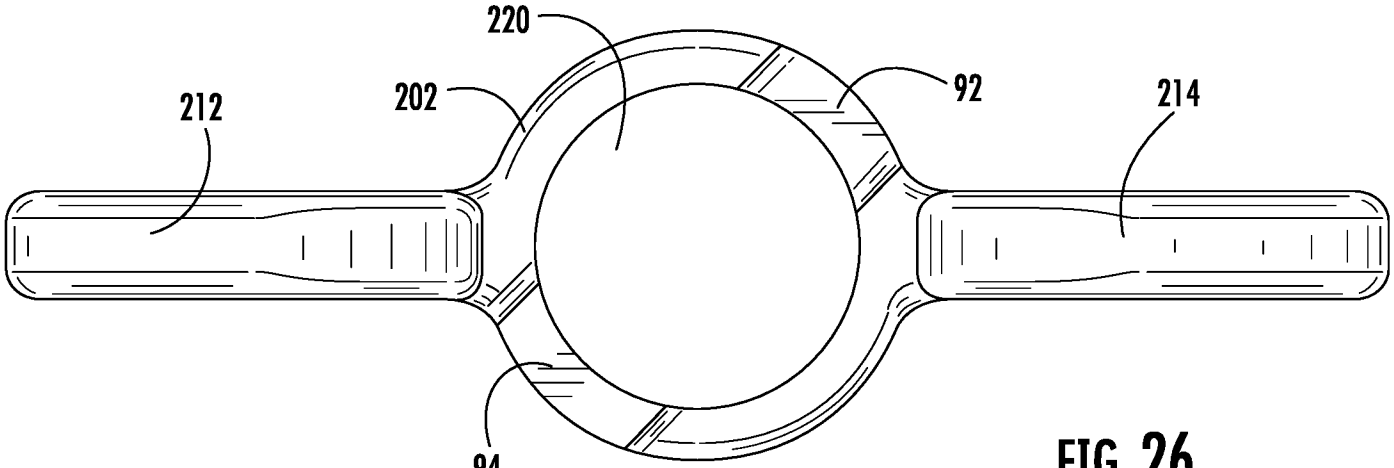
FIG. 26 illustrates a top view of a secondary anchor portion, in accordance with some embodiments of the present disclosure.
Figure 27:
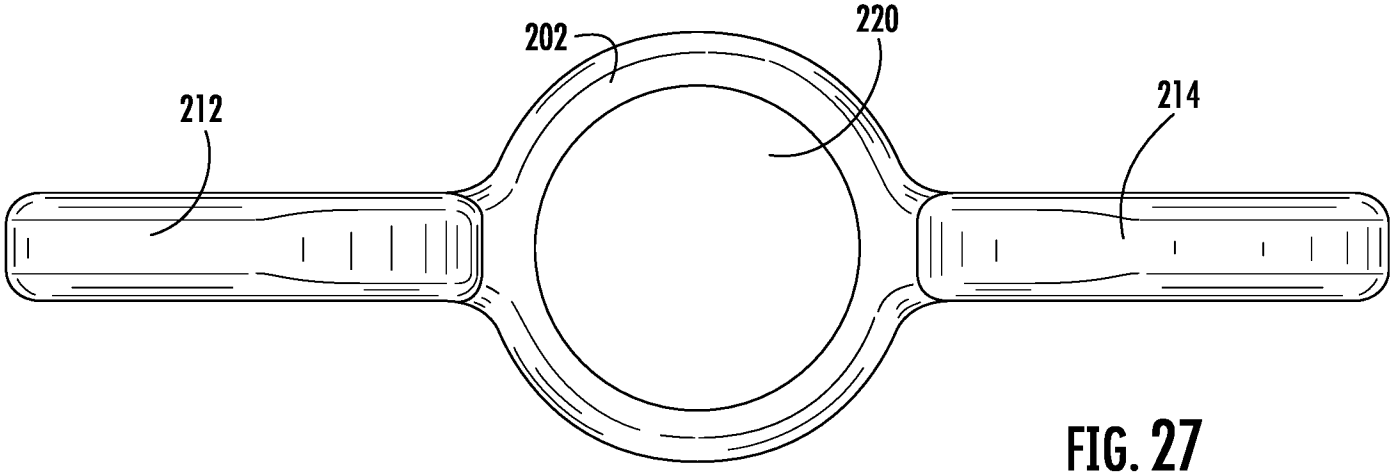
FIG. 27 illustrates a bottom view of a secondary anchor portion, in accordance with some embodiments of the present disclosure.

FIGS. 6 through 18 and 20 through 26, further illustrate a locking mechanism 90 that is used to resist the movement (e.g., rotational movement) of the primary anchor portion 100 with respect to the secondary anchor portion 200 when the locking mechanism 90 is engaged. When the locking mechanism 90 is disengaged, such as in an assembly position, as will be described in further detail herein, the locking mechanism 90 may exert a force on the biasing member 80 (e.g., pre-load the biasing member 80) and/or hold the primary anchor portion 100 and the secondary anchor portion 200 in a position that allows the primary anchor portion 100 and the secondary anchor portion 200 to move with respect to each other after receiving a force, as will be described herein in further detail. In some embodiments of the invention the locking mechanism 90 may comprise one or more tongue 92 and grooves 94. For example, a primary anchor body 102 may comprise one or more tongues 92 (e.g., protuberances, or the like) and/or one or more grooves 94 (e.g., notches, or the like), while the secondary anchor body 202 may also comprise one or more tongues 92 and/or one or more grooves 94. In some embodiments, the primary anchor body 102 may have a single tongue 92 and a single groove 94, as illustrated in FIG. 12, while the secondary anchor body 202 may also have a single tongue 92 and a single groove 94, as illustrated in FIG. 20. In some embodiments, the locking mechanism 90, may comprise multiple teeth that interact with each other, pins and slots that move with respect to each other, and/or the like on the anchor body portions 102, 202.

It should be further understood that the anchor 50 may comprise a stop 85. The stop 85 may be operatively coupled to the fastener 70 and/or the decking panel 2 in order to resist the movement of the anchor 50 within the cavity 10 of the flute 3 of the decking panel 2. For example, the stop 85 may comprise a plate 86 and/or a nut 88, which may be installed, such that the stop 85 (e.g., plate 86 and/or nut 88) contacts (e.g., interacts, engages, or the like) one or more lower flanges 6 of the decking panel 2 adjacent the opening 12 of the cavity 10.

Figure 4A:
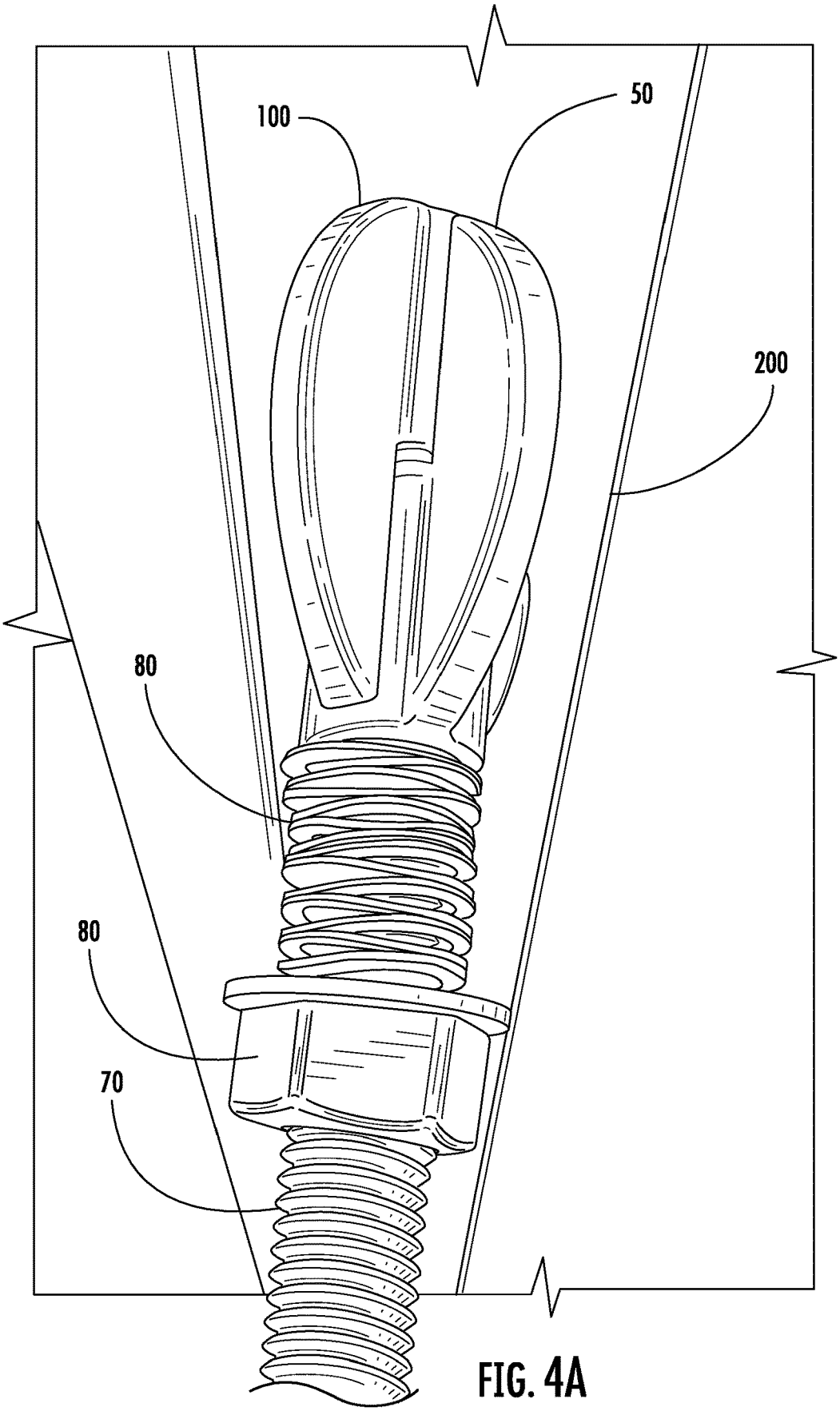
FIG. 4A illustrates a perspective view of an anchor in an assembly position being inserted into a cavity of a flute of a decking panel, in accordance with some embodiments of the present disclosure.

Returning to FIGS. 4A through 4C, the anchor 50 may be configured in an assembly position 310 for assembly into cavity 10 of the flute 3 of the decking panel 2. As illustrated in FIG. 4A, the anchor head 60 may be in an assembly position, in which the primary anchor portion 100, and as such the primary anchor projections 110, and the secondary anchor portion 200, and as such the secondary projections 210, are in a retracted position. That is, the first primary anchor projection 112 and the first secondary anchor projection 212 are adjacent each other, while the second primary anchor projection 114 and the second secondary anchor projection are adjacent each other. In this assembly position (or retracted position) the anchor head 60 may be inserted into a cavity 10 of a flute 3 of a decking panel 3 through an opening 12 in the flute 3 of the decking panel 2.

Figure 4B:
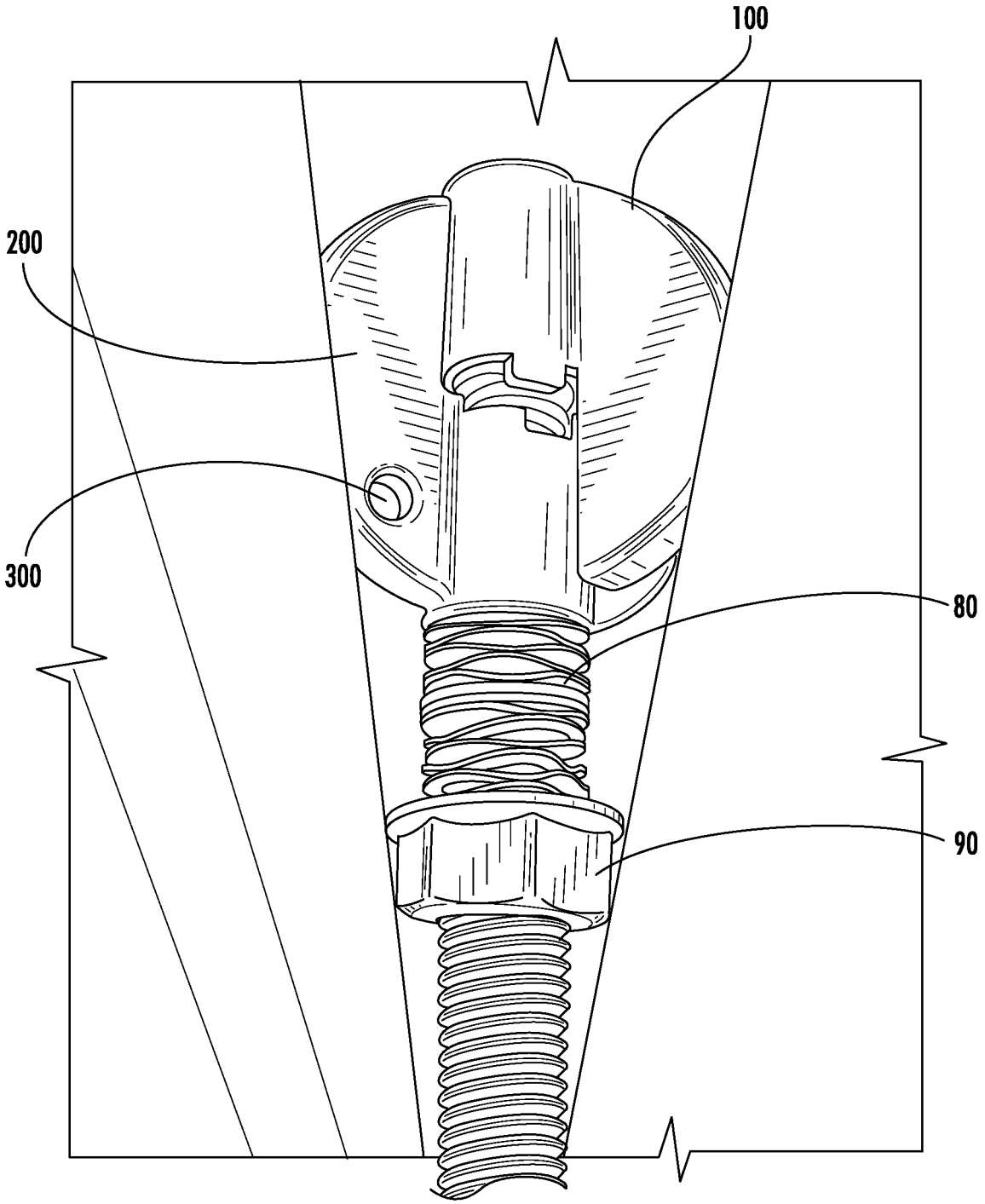
FIG. 4B illustrates a perspective view of an anchor in a pre-installation after being rotated within the cavity of a flute of a decking panel, in accordance with some embodiments of the present disclosure.

After insertion into the cavity 10, in some embodiments the anchor 50 may be rotated to a pre-installed position. It should be understood that the entire anchor 50 may be rotated, or just the anchor head 60 of the anchor 50 may be rotated depending on the structure of the decking anchor 50. For example, the anchor 50 may be rotated into a pre-installed position, such as approximately +/−90 or +/−270 degrees (+/−5, 10, 15, 20, 25, 30, or the like) from the assembly position, as illustrated in FIG. 4B; however, it should be understood that the anchor 50 (or anchor head 60) may be rotated any degree depending on the anchor projections 110, 210 on the anchor bodies 102, 202, and/or the how much the primary anchor portion 100 may move with respect to the secondary anchor portion 200.

Figure 4C:
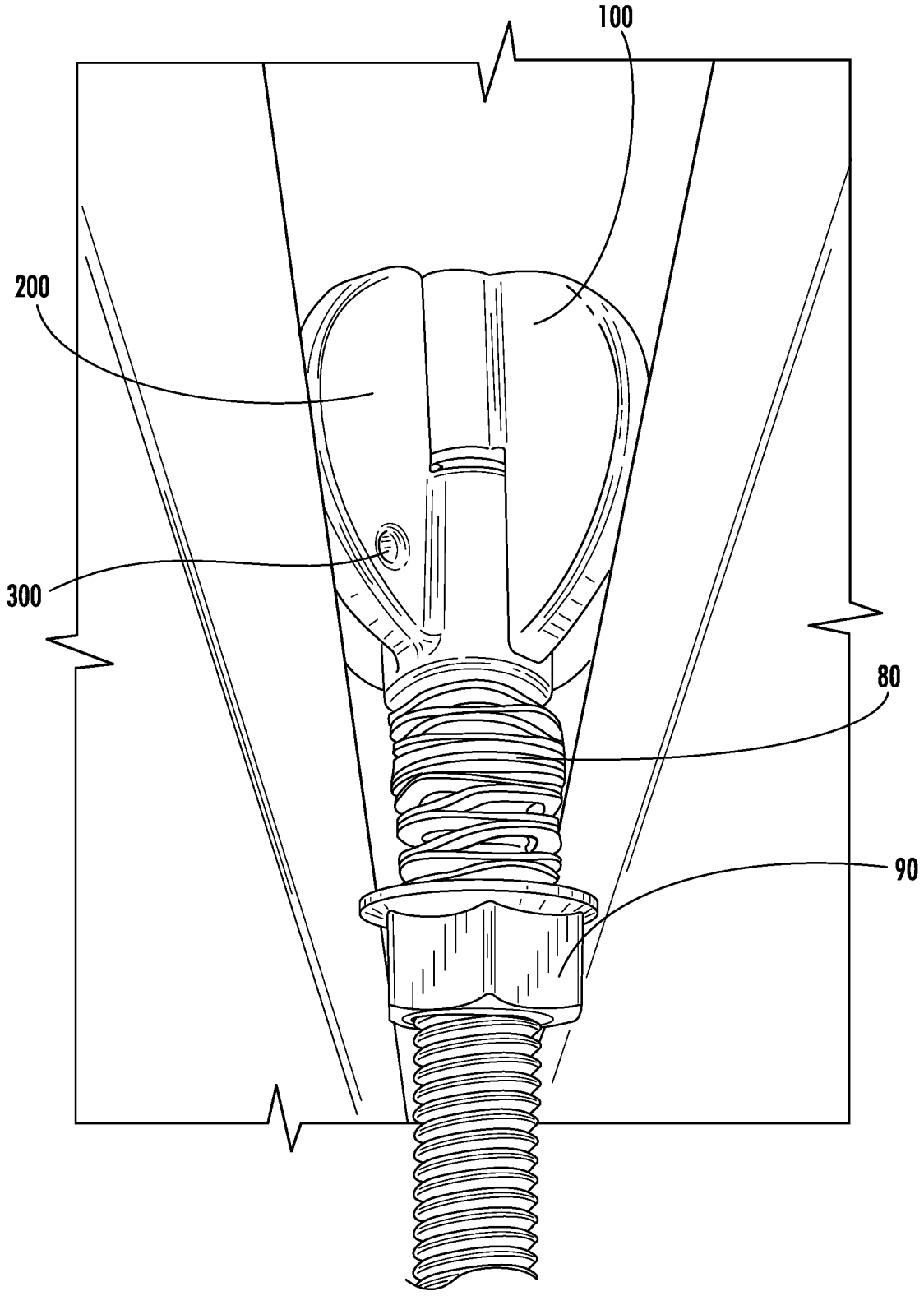
FIG. 4C illustrates a perspective view of an anchor in an installed position within the cavity of a flute of a decking panel, in accordance with some embodiments of the present disclosure.

While in the cavity 10, the anchor 50 may be moved into an installed position, as illustrated in some embodiments in FIG. 4C. As illustrated in FIG. 4C the anchor head 60 may be moved into an installation position, in which the primary anchor portion 100, and as such the primary anchor projections 110, and the secondary anchor portion 200, and as such the secondary projections 210, are moved to an extended position. That is, the first primary anchor projection 112 and the first secondary anchor projection 212 are moved away from each other, while the second primary anchor projection 114 and the second secondary anchor projection 214 are also moved away from each other. In this installation position (or extended position) the secondary anchor portion 200, which may move with respect to the fastener 70, may rotate with respect to the fastener 70 and/or the primary anchor portion 100. Moreover, the biasing member 80 of the anchor 50 may further cause the secondary anchor portion 200 to move towards the primary anchor portion 100, such that the locking mechanism 90 is engaged. For example, the biasing member 80 (e.g., compression spring 82, or the like) may move the secondary anchor body 202 towards the primary anchor body 102, and the locking mechanism 90 may be engaged. That is, one or more tongues 92 on the primary anchor body 102 and/or the secondary anchor body 202 may engage with a groove 94 on the opposing primary anchor body 102 and/or the secondary anchor body 202.

It should be understood that moving the anchor from the assembly position (e.g., with the projections in the retraced position) to the installed position (e.g., with the projections in the extended position) may be performed by exerting a force on the anchor head 60 until the anchor portions 100, 200 snap into place. For example, a user (e.g., installer, or the like) may exert a force on the fastener 70 (e.g., pull the fastener, or the like) until the one or more primary anchor projections 110 and/or the one or more secondary anchor projections 210 contact the webs 9 of the of the decking panels 2. The exertion of the force causes the first and second primary projections 110, and thus the primary anchor body 102, to move in a rotational direction (e.g., counterclockwise) and/or move the first and second secondary projections 210, and thus the secondary anchor body 202, to move in a rotational direction (e.g., a clockwise direction). In some embodiments since the fastener 70 may be fixed with respect to the primary anchor portion 100 only the secondary anchor portion 200 may rotate, or alternatively, the fastener 70 and primary anchor portion 100 may rotate as described herein (e.g., counterclockwise). The direction of rotation described herein for the primary anchor portion 100 and/or the secondary anchor portion 200 is illustrated for example purposes only, and it should be understood these elements may rotate in a different direction depending on how the primary anchor portion 100 is operatively coupled to the secondary anchor portion 200.

During the movement of the anchor head 60 from the assembly position to the installation position, when the locking mechanism 90 snaps into place a noise may be made such that a user can confirm that the anchor 50 is in the installed position. A positioning feature may also provide a visual confirmation that the locking mechanism 90 of anchor head 60 is in the installed position. For example, a line, colors, protuberances, groove, or the like included within or on the primary anchor body 102 and/or the secondary anchor body 202 may provide visual conformation (e.g., line up, connect, or the like) when the anchor head 60 is in the installed position. In other embodiments of the invention, instead of a user exerting a force on the anchor head 60 until the anchor head 60 is moved into an installed position, a tool, engagement feature (e.g., trigger, latch, or the like), or the like may be used to move the anchor head 60 from an assembly position to an installed position.

Regardless of how the primary anchor projections 110 and the secondary anchor projections 210 move into to an extended position (e.g., from a force applied by an installer, or the like), the anchor head 60, once in the installed position, can no longer pass through the opening 10 of the cavity 12 of the flute 3 of the decking panel 2 regardless of the orientation of the anchor head 60. For example, the anchor head 60 may be rotated within the cavity 10, angled in any orientation with respect to the plane of the decking (e.g., with respect to the opening 10 of the cavity 12, the plane of the lower flute 6, or the like), slid within the cavity 10, or the like without being removed from the cavity 10.

The anchor head 60 may have a removal mechanism 300, such as in the one or more anchor projections (e.g., primary anchor projections 110, secondary anchor projections 210, or the like). The removal mechanism 300 may be used to unlock the locking mechanism 90. In some embodiments, the removal mechanism 300 may comprise one or more projection apertures 302 in the one or more primary anchor projections 110 and/or the one or more secondary anchor projections 210. Alternatively, and/or additionally, the removal mechanism 300 may be operatively coupled to the primary anchor body 102, secondary anchor body 202, biasing member 80, or the like.

Figure 29C:
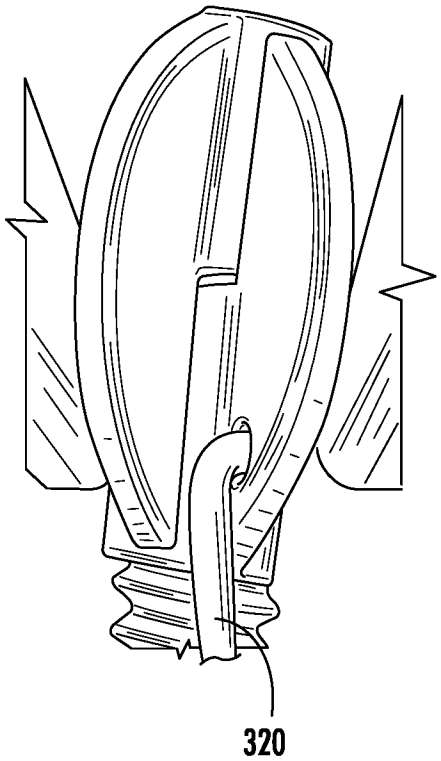
FIG. 29C illustrates an anchor being removed using the removal tool, in accordance with some embodiments of the present disclosure.
Figure 29B:
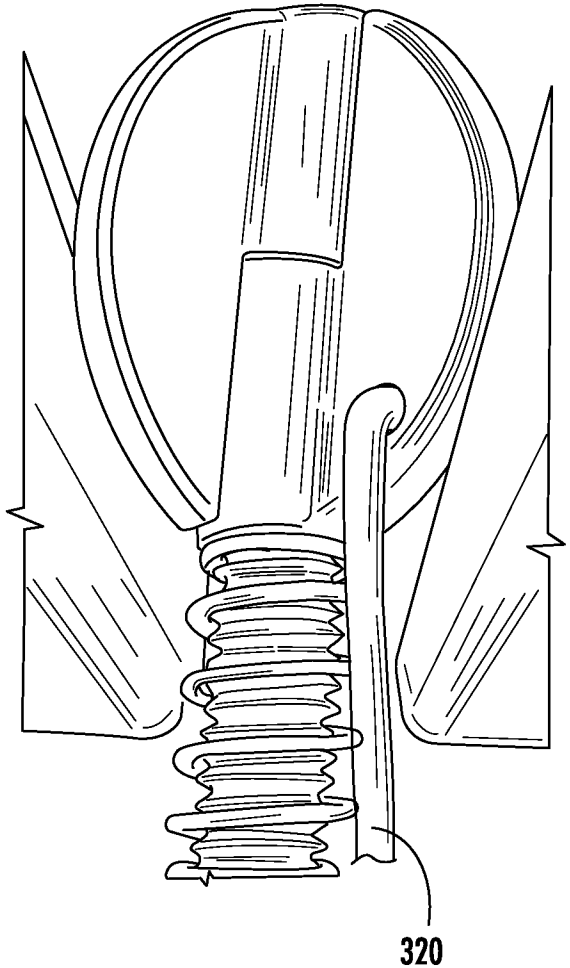
FIG. 29B illustrates an installed anchor with a removal tool operatively coupled to a removal mechanism, in accordance with some embodiments of the present disclosure.
Figure 29A:
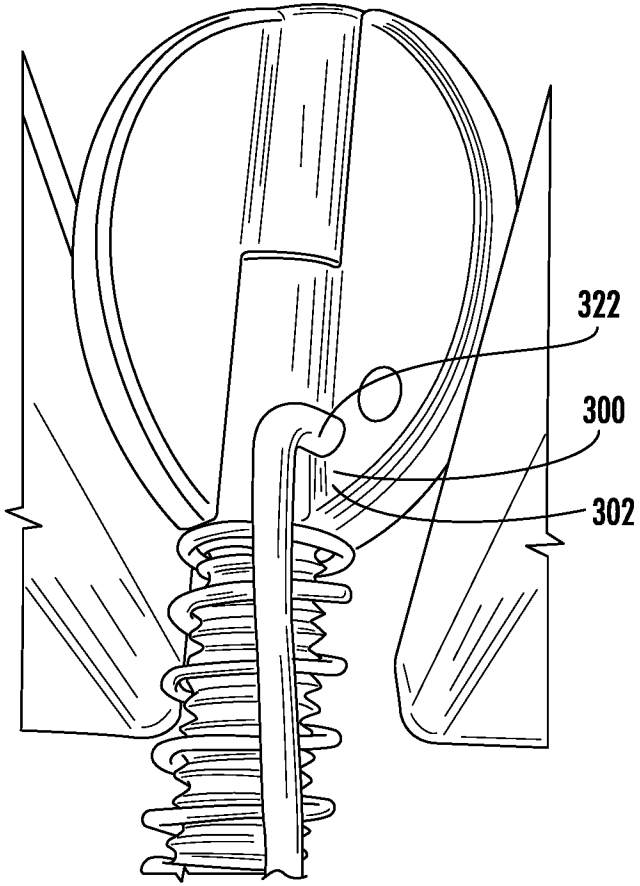
FIG. 29A illustrates an installed anchor with a removal tool, in accordance with some embodiments of the present disclosure.

In some embodiments, as illustrated in FIGS. 29A through 29C, the removal mechanism 300 is an aperture 302 (e.g., slot, through hole, or the like) in the one or more primary projections 110 and/or the one or more secondary projections 210. Moreover, a removal tool 320 may be utilized to aid in removing the anchor 50 from the decking panel 2. In some embodiments, the removal tool 320 may have an extension portion 322 (e.g., key, hook, wire, or the like) that may be utilized to remove the anchor 50 from the decking 2. For example, a portion of the removal tool 320 (e.g., extension portion 322 or the like) may be operatively coupled to the removal mechanism 300, such as the aperture 302 in one of the one or more projections 110, 210, as illustrated in FIG. 29B. The user (e.g., installer) may apply a force to the removal tool 320 (e.g., downward, or the like) and a force in the opposite direction (e.g., upward, or the like) to the fastener 70. Alternatively, the force applied to the removal tool 320 may be upward, rotational, or the like. In this way, the locking mechanism 90 may be disengaged, such that the primary anchor portion 100 (e.g., the primary anchor body 102) may be moved, such as moved away from the secondary anchor portion 200 (e.g., the secondary anchor body 202) and/or rotated with respect to each other. For example, the spring 82 may be compressed as the secondary anchor portion 200 is moved away from the primary anchor portion 100. The first primary anchor projection 112 and the first secondary anchor projection 212, and the second primary anchor projection 124 and the second secondary anchor projection 214, respectfully, may be moved (e.g., rotated) toward each other into retracted position. As such, the anchor head 60 may be moved from an installed position (e.g., extended position) to a removal position (e.g., retracted position), which is the same as or similar to the assembly position, in order to remove the anchor head 60 from the cavity 10 through the opening 12 of the flute 3.

Figure 28:
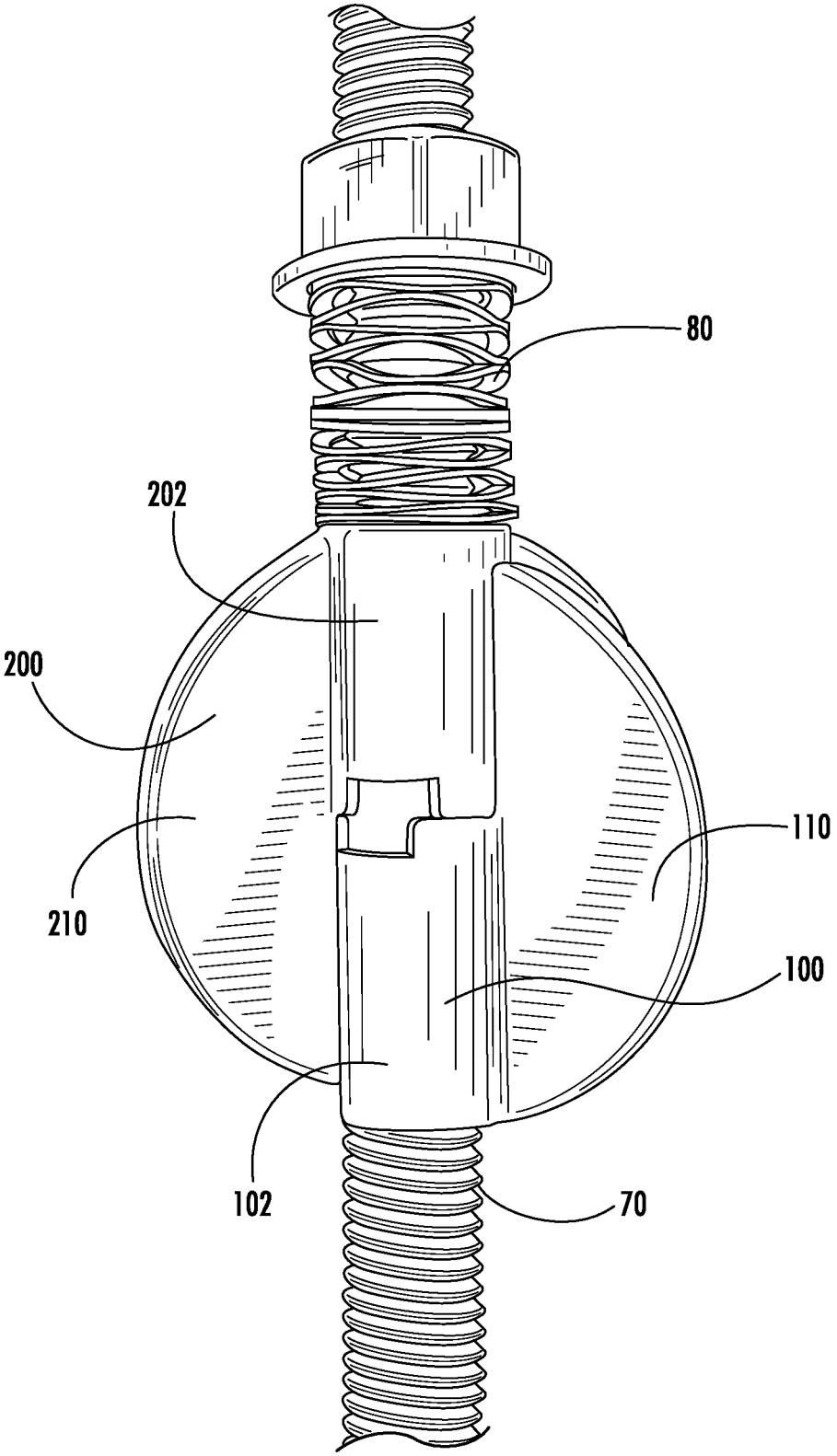
FIG. 28 illustrates a side view of an alternate configuration for the anchor head, in accordance with some embodiments of the present disclosure.

While FIGS. 1 through 27 illustrate that when the anchor 50 is installed, the primary anchor portion 100 is located above the secondary anchor portion 200, and the primary anchor portion 100 and the secondary anchor portion 200 are located above the biasing member 80 (e.g., the spring 82). Alternatively, as illustrated in FIG. 28, the fastener 70 (e.g., threaded bolt, or the like) may be operatively coupled to the secondary anchor portion 200 (e.g., the lower anchor portion, or the like), extend past the primary anchor portion 100, and be operatively coupled to the biasing member 80 where the fastener 70 extends past the primary anchor portion 100 (e.g., a spring 82 and stop operatively coupled to the fastener 70). In other embodiments, the biasing member may be located between the primary anchor portion 100 and the secondary anchor portion 200 (e.g., between the primary anchor body 102 and the secondary anchor body 202, or the like). In other embodiments, the anchor 50 may be operatively coupled to the fastener 70 in other ways.

Figure 30:
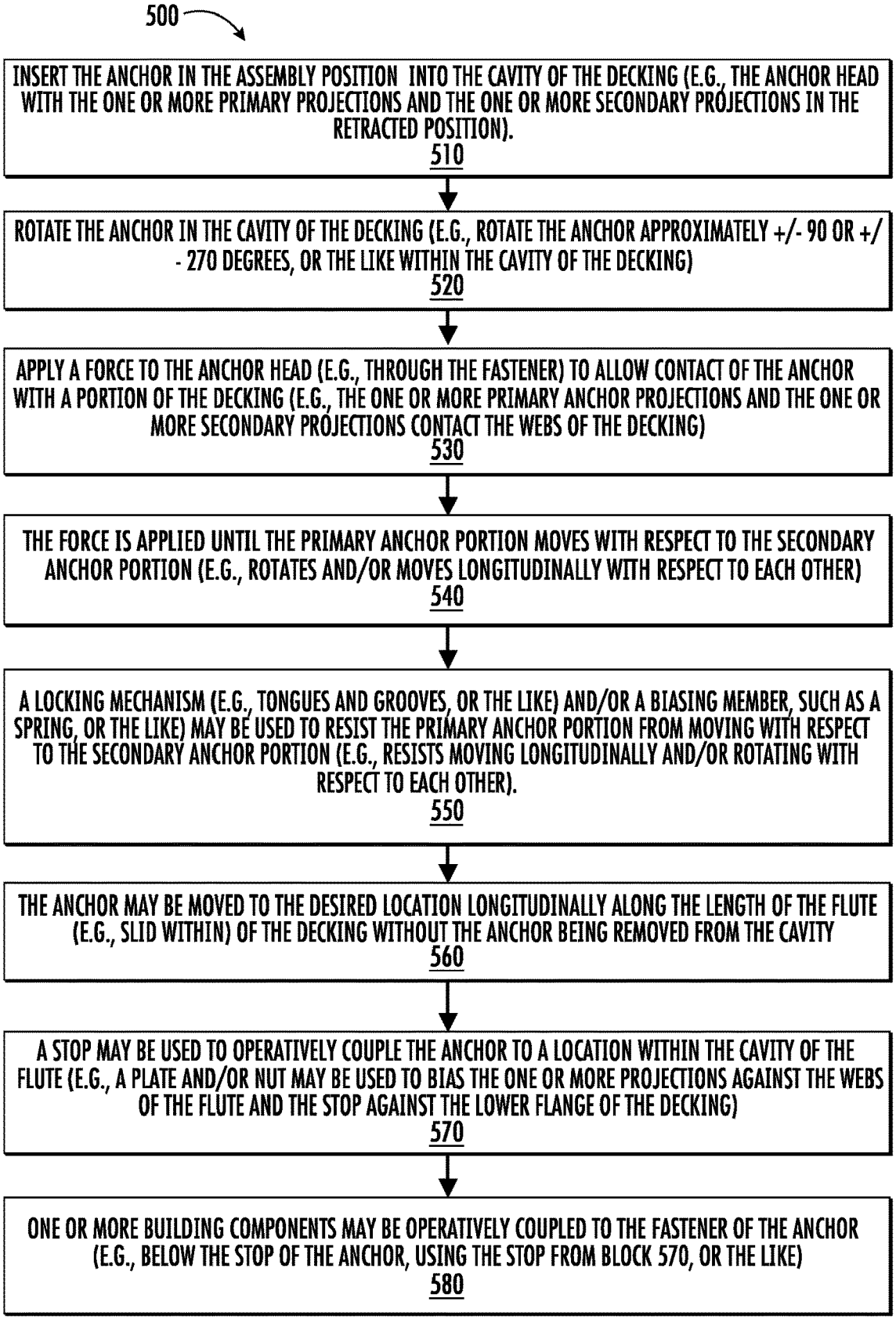
FIG. 30 illustrates a process of installing anchors in flutes of decking panels, in accordance with some of the embodiments of the present disclosure.

FIG. 30 provides an installation process 500 flow for installing the anchors 50 described herein, regardless of how the anchors 50 are assembled. Block 510 of FIG. 30 illustrates that the anchor 50 is inserted into the cavity 10 of the flute 3 of the decking panel 2 through the opening 10 in the decking panel 2, as previously discussed and illustrated with respect to FIG. 4A. For example, before insertion into the cavity 10, the one or more primary anchor projections 110 and the one or more secondary anchor projections 210 are retracted such that the anchor head 60 is moved into the assembly position.

FIG. 30 further illustrates in block 520 that the anchor 50 may be rotated within the cavity 10 of the decking panel 2 to move the anchor 50 to a pre-installed position. For example, the anchor head 60 may be rotated approximately +/−90 or +/−270 degrees (e.g., +/−2, 4, 6, 8, 10, 15, 20, 25, 30, 35, or the like degrees) in order to place the anchor head 60 in the desired position for extension of the anchor projections (e.g., the one or more primary anchor projections 110 and/or the one or more secondary anchor projections 210). In the illustrated embodiments, the anchor 50 is rotated within the cavity 10; however, in some embodiments the anchor 50 may not be required to be rotated, and instead the anchor projections 110, 210 may be extended into the installed position without rotation of the anchor 50 or element thereof (e.g., anchor head 60, or the like).

Block 530 further illustrates in FIG. 30 that a user applies a force to the anchor head 60, directly, or through the fastener 70 or other like feature operatively coupled to the anchor head 60. The force applied may result in the anchor projections (e.g., the one or more primary anchor projections 110 and/or the one or more secondary anchor projections 210) contacting the webs 9 within the cavity 10 of the flute 3 of the decking panels 2, as previously described and illustrated with respect to FIG. 4B.

FIG. 30 further illustrates in block 540 that the force is applied to the anchor head 60, directly, or through the fastener 70 or other like feature operatively coupled the anchor head 60, until the primary anchor portion 100 and/or the secondary anchor portion 200 move with respect to each other. That is, rotate and/or move longitudinally to engage each other, as previously described and illustrated with respect to FIG. 4C. For example, a biasing member 80 (e.g., a spring 82, or the like) may bias the primary anchor portion 100 with respect to secondary anchor portion 200 to resist longitudinal movement (or other directional movement) of the primary anchor portion 100 with respect to the secondary anchor portion 200.

Furthermore, as illustrated by block 550, a locking mechanism 90 is utilized to lock the primary anchor portion 100 and the secondary anchor portion 200 in place with respect to each other to restrict movement (e.g., rotational movement, or the like) between the primary anchor portion 100 and the secondary anchor portion 200. As previously described herein, the primary anchor portion 100 and the secondary anchor portion 200, or the elements thereof (e.g., the locking mechanism 90), may make a noise (e.g., snap into place, or the like) and/or have alignment features that allow a user to confirm that the anchor head 60 has been moved to the installation position (e.g., the projections 110, 210 have been moved into the extended position).

Block 560 of FIG. 30 illustrates that in some embodiments, when the anchor 50 is installed into the installation position it cannot be removed from the opening 12 of the cavity 10 of the flute 3 of the decking 2; however, the anchor 50 may be moved along the length of the flute 3 to the desired location within the flute 3 of the decking panel 2 (e.g., slid within the flute 3).

FIG. 30 further illustrates in block 570 that a stop 85 may be utilized in order to position the anchor 50 in the desired location to prevent additional movement of the anchor 50 within the flute 3. As described herein, the stop 85 (e.g., a plate 86 and/or a nut 88) is biased against the lower flange 6 and/or the projections 110, 210 of the anchor head 60 are biased against the webs 9 at the same time to secure the anchor 50 in place.

One or more components (e.g., building components, or the like) may be operatively coupled to the fastener 70 of anchor 50. For example, the fastener 70 may be a rod from which components may be hung, a threaded bolt or screw to which the components may be operatively coupled, or the like. Multiple anchors 50 may be installed within the flutes 3 of the decking panel 2 in order hang various components below decking panel 2. That is, piping, HVHC, lighting, products (e.g., products within a store, or the like), structural building components (e.g., racking systems, lateral bracing, or the like), and/or the like may be installed.

Hanging components, such as lights, HVAC, pipes, and/or other building components, from structural decking panels 2 (e.g., floor, ceiling or roof structural decking) can be a time intensive and multi-stepped process. For example, typical processes may require a lift or ladder to reach the structural decking 2, using a drill to drill into the structural decking panels 2, and in some cases, into concrete above such decking panels 2, and utilizing tools to install an anchor into the drilled portions of the decking 2 and/or the concrete. Additionally, traditional processes may require both hands to secure an anchor into a flute 3 of the decking panel 2, which may require harnesses and/or other safety protocols for installation. Moreover, if the anchor system requires repositioning in the future, the multistep process must be repeated, and in some cases the concrete and/or decking 2 is repaired.

Unlike traditional anchors 50 and decking systems 1, as previously described with respect to FIGS. 29A to 29C, the one more anchors 50 may be installed and/or repositioned easily, due at least in part to the non-destructive nature of the anchors 50. The anchors 50 may be installed in the decking using one hand, as described herein. That is, the installation process does not require drilling, deforming, or the like of the decking 2 and/or the anchors 50 themselves. In some embodiments the stop 85 may be at least partially disengaged (e.g., loosened, removed, or the like) and the anchor 50 may be slid along the decking 2 within the cavity 10 and/or easily removed and replaced at a different location within the cavity 10 of the decking panel 2. Finally, in some embodiments while a lift, ladder, or the like may be required for installation, since the anchors 50 may be installed using one hand variously safety measure may not be required (e.g., harnesses, or the like).

Moreover, it should be further understood that since the anchors 50 may be installed by insertion into a cavity 10, rotation within the cavity 10, and the application of a force to snap the anchor head 60 into the installed position, the anchors 50 may be installed from the ground. Consequently, in some embodiments the anchors 50 may be installed using an installation tool (e.g., operatively coupled to the fastener 70, such as to a threaded portion of the fastener 70) that may allow an installer to insert an anchor 50 into the cavity 10, rotate the anchor 50 to the pre-installed position, exert a force (e.g., pull-down on the anchor 50), or the like with the installer standing on the ground. The installation tool may include a clamp that may be activated through a trigger from the ground, or the like. As such, by utilizing an installation tool the installer is would not be required to utilize a latter, lift, or the like and/or the safety components that may be required when an installer utilizes a latter, lift, or the like.

It should be understood that "operatively coupled," when used herein, means that the components may be formed integrally with each other, or may be formed separately and coupled together. Furthermore, "operatively coupled" means that the components may be formed directly to each other, or to each other with one or more components located between the components that are operatively coupled together. Furthermore, "operatively coupled" may mean that the components are detachable from each other, or that they are permanently coupled together.

Certain terminology is used herein for convenience only and is not to be taken as a limitation on the embodiments described. For example, words such as "top", "bottom", "upper," "lower," "left," "right," "horizontal," "vertical," "upward," and "downward" merely describe the configuration shown in the figures and/or from the reference point of an observer located on the ground below the decking 2. Indeed, the referenced components may be oriented in any direction and the terminology, therefore, should be understood as encompassing such variations unless specified otherwise. Throughout this disclosure, where a process or method is shown or described, the method may be performed in any order or simultaneously, unless it is clear from the context that the method depends on certain actions being performed first.

Also, it will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa. In addition, where possible, any terms expressed in the singular form herein are meant to also include the plural form and/or vice versa, unless explicitly stated otherwise. Accordingly, the terms "a" and/or "an" shall mean "one or more."

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

What is claimed is:

1. A decking anchor, the anchor comprising:

an anchor head comprising:

a primary anchor portion with two primary anchor projections comprising a first primary anchor projection and a second primary anchor projection; and a secondary anchor portion with two secondary anchor projections comprising a first secondary anchor projection and a second secondary anchor projection;

wherein the secondary anchor portion is operatively coupled to the primary anchor portion such that in an assembly position the two primary anchor projections and the two secondary anchor projections form a retracted x-shape and in an installed position the two primary anchor projections and the two secondary anchor projections form an extended x-shape after the first primary anchor projection moves away from the first secondary anchor projection and the second primary anchor projection moves away from the second secondary anchor projection; and a fastener operatively coupled to the primary anchor portion or the secondary anchor portion of the anchor head;

wherein in the assembly position the primary anchor portion and secondary anchor portion are configured to pass through an opening into a cavity of a flute of decking, wherein the flute comprises an upper flange, a portion of a first lower flange and a portion of a second lower flange, and opposing webs operatively coupling the upper flange and the portion of the first lower flange and the portion of the second lower flange; and wherein in the installed position the first primary anchor projection and the first secondary anchor projection are configured to contact a first web of the opposing webs, and the second primary anchor projection and the second secondary anchor projection are configured to contact a second web of the opposing webs.

2. The anchor of claim 1, wherein the two primary anchor projections are configured to rotate with respect to the two secondary anchor projections in response to the two primary anchor projections and the two secondary anchor projections being biased against the opposing webs in the cavity of the decking.

3. The anchor of claim 1, further comprises a biasing member, wherein the biasing member biases the primary anchor portion and the secondary anchor portion together.

4. The anchor of claim 1, wherein in both the assembly position and the installed position a portion of the two primary anchor projections of the primary anchor portion and a portion of the two secondary anchor projections of the secondary anchor portion extend past each other such that the two primary anchor projections and the two secondary anchor projections are prevented from rotating past each other.

5. The anchor of claim 1, wherein the primary anchor portion comprises a primary anchor aperture and wherein the secondary anchor portion comprises a secondary anchor aperture, and wherein the primary anchor aperture and the secondary anchor aperture are operatively coupled through the fastener.

6. The anchor of claim 5, wherein the fastener comprises a fastener threaded portion and wherein the primary anchor aperture comprises a primary aperture threaded portion, and wherein the fastener threaded portion is operatively coupled to the primary aperture threaded portion.

7. The anchor of claim 1, wherein the anchor head comprises a locking mechanism.

8. The anchor of claim 7, wherein the locking mechanism comprises a tongue and groove connection operatively coupled to the primary anchor portion or the secondary anchor portion, wherein in the assembly position the tongue and groove connection is unlocked and in the installed position the tongue and groove connection is locked.

9. The anchor of claim 1, wherein at least a portion of the two primary anchor projections or the two or more secondary anchor projections comprise a curved surface.

10. The anchor of claim 1, further comprises:

a removal mechanism operatively coupled to the primary anchor portion or the secondary anchor portion, wherein the removal mechanism allows movement of the primary anchor portion with respect to the secondary anchor portion.

11. The anchor of claim 10, wherein the removal mechanism comprises one or more removal apertures in the primary anchor portion or the secondary anchor portion, wherein the one or more removal apertures receives a tool for moving the primary anchor portion with respect to the secondary anchor portion.

12. The anchor of claim 1, further comprising:

a stop operatively coupled to the fastener, wherein the stop impedes movement of the anchor within the decking when the stop is operatively coupled to the decking.

13. A decking system, the system comprising:

decking having a plurality of flutes, wherein each of the plurality of flutes comprise an upper flange, a portion of a first lower flange and a portion of second lower flange, and opposing webs operatively coupling the upper flange to the portion of the first lower flange and the portion of the second lower flange; and one or more anchors, wherein each of the one or more anchors comprise:

an anchor head comprising:

a primary anchor portion with two primary anchor projections comprising a first primary anchor projection and a second primary anchor projection; and a secondary anchor portion with two secondary anchor projections comprising a first secondary anchor projection and a second secondary anchor projection;

wherein the secondary anchor portion is operatively coupled to the primary anchor portion such that in an assembly position the two primary anchor projections and the two secondary anchor projections form a retracted x-shape and in an installed position the two primary anchor projections and the two secondary anchor projections form an extended x-shape after the first primary anchor projection moves away from the first secondary anchor projection and the second primary anchor projection moves away from the second secondary anchor projection; and a fastener operatively coupled to the primary anchor portion or the secondary anchor portion of the anchor head;

wherein in the assembly position the primary anchor portion and the secondary anchor portion are configured to pass through an opening into a cavity of a flute of the decking; and wherein in the installed position the first primary anchor projection and the first secondary anchor projection are configured to contact a first web of the opposing webs, and the second primary anchor projection and the second secondary anchor projection are configured to contact a second web of the opposing webs.

14. The decking system of claim 13, wherein the two primary anchor projections are configured to rotate with respect to the two secondary anchor projections in response to the two primary anchor projections and the two secondary anchor projections being biased against the opposing webs in the cavity of the flute of the decking.

15. The decking system of claim 13, wherein the one or more anchors further comprise:

a biasing member, wherein the biasing member biases the primary anchor portion and the secondary anchor portion together.

16. The decking system of claim 13, wherein the primary anchor portion comprises a primary anchor aperture and wherein the secondary anchor portion comprises a secondary anchor aperture, and wherein the primary anchor aperture and the secondary anchor aperture are operatively coupled through the fastener.

17. The decking system of claim 13, wherein the anchor head comprises a locking mechanism.

18. A method of installing an anchor in decking, the method comprising:

installing an anchor head into a cavity of a flute within the decking with the anchor head in an assembly position;

wherein the decking comprises a plurality of flutes, wherein the plurality of flutes comprise an upper flange, a portion of a first lower flange and a portion of second lower flange, and opposing webs operatively coupling the upper flange to the portion of the first lower flange and the portion of the second lower flange; and wherein the anchor comprises:

the anchor head comprising:

a primary anchor portion with two primary anchor projections comprising a first primary anchor projection and a second primary anchor projection; and a secondary anchor portion with two secondary anchor projections comprising a first secondary anchor projection and a second secondary anchor projection;

wherein the secondary anchor portion is operatively coupled to the primary anchor portion such that in the assembly position the two primary anchor projections and the two secondary anchor projections form a retracted x-shape and in an installed position the two primary anchor projections and the two secondary anchor projections form an extended x-shape after the first primary anchor projection moves away from the first secondary anchor projection and the second primary anchor projection moves away from the second secondary anchor projection; and a fastener operatively coupled to the primary anchor portion or the secondary anchor portion of the anchor head;

wherein in the assembly position the primary anchor portion and the secondary anchor portion are configured to pass through an opening into the cavity of the flute of the decking;

installing the anchor into the installed position; and wherein in the installed position the first primary anchor projection and the first secondary anchor projection are configured to contact a first web of the opposing webs, and the second primary anchor projection and the second secondary anchor projection are configured to contact a second web of the opposing webs.

19. The method of claim 18, wherein the two primary anchor projections are configured to rotate with respect to the two secondary anchor projections in response to the two primary anchor projections and the two secondary anchor projections being biased against the opposing webs in the cavity of the flute of the decking.

20. The method of claim 18, wherein the anchor further comprises:

a biasing member, wherein the biasing member biases the primary anchor portion and the secondary anchor portion together.

* * * * *